US008145088B2

(12) United States Patent
Morooka

(10) Patent No.: US 8,145,088 B2
(45) Date of Patent: Mar. 27, 2012

(54) PRINT MANAGEMENT APPARATUS, PRINT MANAGEMENT METHOD, COMPUTER-READABLE RECORDING MEDIUM, AND COMPUTER PROGRAM

(75) Inventor: Hidekazu Morooka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 466 days.

(21) Appl. No.: 12/415,584

(22) Filed: Mar. 31, 2009

(65) Prior Publication Data

US 2009/0252524 A1 Oct. 8, 2009

(30) Foreign Application Priority Data

Apr. 1, 2008 (JP) ..... 2008-095507

(51) Int. Cl.
*G03G 15/00* (2006.01)

(52) U.S. Cl. ..... 399/82
(58) Field of Classification Search ..... 399/82, 399/38, 75, 76, 77, 381, 382
See application file for complete search history.

(56) References Cited

U.S. PATENT DOCUMENTS

2010/0226693 A1* 9/2010 Stelter ..... 399/299
2010/0232836 A1* 9/2010 Stelter ..... 399/223

FOREIGN PATENT DOCUMENTS

JP 9-174956 A 7/1997

* cited by examiner

*Primary Examiner* — Sophia S Chen
(74) *Attorney, Agent, or Firm* — Canon U.S.A., Inc., IP Division

(57) ABSTRACT

A print management apparatus includes a generation unit configured to generate, from a document including a clear toner page on which both colored toner and clear toner are used and an insert page on which the colored toner is used without the use of the clear toner, a clear toner page print job for printing the clear toner page by using the colored toner without using the clear toner, and an insert print job for applying the clear toner on the clear toner page printed by using the colored toner without using the clear toner and for printing the insert page by using the colored toner. The print management apparatus also includes a first instruction unit configured to instruct an execution of the clear toner page print job, and a second instruction unit configured to instruct an execution of the insert print job after a predetermined period of time elapses.

16 Claims, 19 Drawing Sheets

FIG. 8

```
- <DigitalPrintingParams Class="Parameter" ID="IDDPP" Status="Available" Collate="SheetSetAndJob" PartIDKeys="RunIndex">
    <Cj:TrustPrint NoOp="true"/>
    <MediaRef rRef="RES_000"/>
  - <DigitalPrintingParams RunIndex="2~7" ClearPage="Available"/>
      <MediaRef rRef="RES_001"/>
    </DigitalPrintingParams>
  - <DigitalPrintingParams RunIndex="9~13" ClearPage="Available"/>
      <MediaRef rRef="RES_002"/>
    </DigitalPrintingParams>
  </DigitalPrintingParams>
  <Component Class="Quantity" ID="IDC"ComponentType="FinalProduct" Status="Unavailable"/>
- <Media ID="RES_000" Classe="Consumable" Status="Available" Dimension="595 842">
    <Location LocationName="AutoSelect" />
  </Media>
  <Media ID="RES_001" Class="Consumable" Status="Available" Dimension="595 842"/>
  <Media ID="RES_002" Class="Consumable" Status="Available" Dimension="842 1191"/>
```

PRINT MANAGEMENT APPARATUS, PRINT MANAGEMENT METHOD, COMPUTER-READABLE RECORDING MEDIUM, AND COMPUTER PROGRAM

BACKGROUND OF THE INVENTION

1. Field of the Invention

The present invention relates to a print management apparatus, a print management method, a computer-readable recording medium, and a computer program therefor. In particular, the invention relates to a print management apparatus, a print management method, a computer-readable recording medium, and a computer program which are suitably used for executing printing by using clear toner on the same page on which printing by using colored toner has been executed.

2. Description of the Related Art

Up to now, a method of reconstructing jobs by selecting an arbitrary page from all jobs developed into printable data and performing the printing has been proposed.

This technology is aimed to avoid duplicate saving of common pages between the jobs when data is read from the saved job to perform printing. To be more specific, this technology can be applied to a use in which a Web page is developed and a layout of a plurality of pages is made on one sheet for performing printing, or a use in which a job is generated by gathering only desired pages for performing printing (see Japanese Patent Laid-Open No. 9-174956).

Incidentally, a method of increasing added values while a part of a document is printed by using clear toner (i.e., transparent toner) to provide gloss to a printed manner has been proposed.

However, in a normal printing method, the following issues may occur when printing is performed by using the clear toner.

Air Bubbles

If clear toner is placed on a sheet still retaining heat, air bubbles or cracks may be generated on an image.

Restriction on Toner Bearing Amount

As an upper limit exists for a toner bearing amount through one performance, if the toner is borne up to the maximum toner bearing amount in CMYK printing (i.e., printing by using colored toner), the clear toner may not be able to be borne any more.

As a measure for addressing the above-described issues, a two-path method is proposed for performing a printing process as follows. That is, all the pages are printed by using the colored toner once. Then, after the printed product obtained by performing the printing is cooled down (e.g., after a printed product resting time elapses), printing by using the clear toner is performed.

However, according to this method, a user may typically need to set the printed product again in the printer. For this reason, when a large amount of sheets are printed, an enormous amount of sheets may need to be set in the printer again, and the operational loads can become large. Also, a method has been proposed where a page to be printed by using the clear toner is taken out by an operator, and only the relevant part is printed by using the clear toner. However, with such a method, it may be necessary to perform post processing such as page merge processing, and thus the operability may be compromised.

In addition, according to the above-mentioned method, it may be necessary to provide a time for cooling the printed product down. However, in a case where the time for the cooling down is not sufficient, air bubbles or cracks may be generated on the printed product, and a desired printed product may not be obtained in some cases. For this reason, the operator may need to precisely grasp the time for cooling the printed product down.

SUMMARY OF THE INVENTION

According to one aspect of the invention, a print management apparatus is provided that includes a generation unit configured to generate, from a document including a clear toner page on which both colored toner and clear toner are used and an insert page on which the colored toner is used without the use of the clear toner, a clear toner page print job for printing the clear toner page by using the colored toner without using the clear toner, and generate an insert print job for applying the clear toner on the clear toner page printed by using the colored toner without using the clear toner and for printing the insert page by using the colored toner. The print management apparatus also includes a first instruction unit configured to instruct an execution of the clear toner page print job generated by the generation unit, and a second instruction unit configured to instruct an execution of the insert print job generated by the generation unit after a predetermined period of time elapses.

According to another aspect of the invention, a print management apparatus is provided that includes an identification unit configured to identify, from a document including a clear toner page on which both colored toner and clear toner are used and an insert page on which the colored toner is used without the use of the clear toner, the clear toner page. The print management apparatus also includes a first instruction unit configured to instruct printing of the clear toner page identified by the identification unit by using the colored toner without the clear toner, and a second instruction unit configured to instruct printing of the insert print job after the instruction performed by the first instruction unit.

Further features of the present invention will become apparent from the following description of exemplary embodiments with reference to the attached drawings.

BRIEF DESCRIPTION OF THE DRAWINGS

FIG. 8 illustrates an example of print instruction information (job ticket) in which pages 2 to 7 and pages 9 to 13 are specified as clear toner pages according to the first exemplary embodiment of the present invention.

DESCRIPTION OF THE EMBODIMENTS

Figure 1:
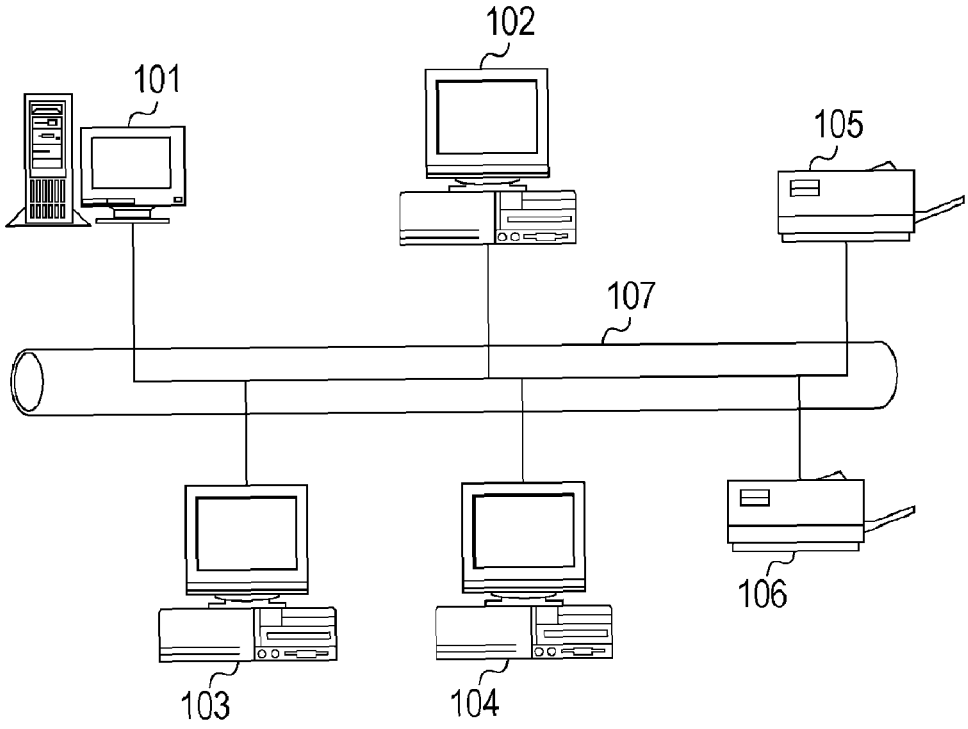
FIG. 1 is a block diagram of a configuration example of a print management system according to a first exemplary embodiment of the present invention.

Hereinafter, a first exemplary embodiment of the present invention will be described in detail with reference to the drawing.

System Configuration and Operation

FIG. 1 is a block diagram of a configuration example of a print management system.

In FIG. 1, client computers 102 to 104 are composed of information processing apparatuses and connected via a network cable such as Ethernet (registered trademark) to a network 107. The client computers 102 to 104 can execute various programs such as application programs. Also, in the client computers 102 to 104, a printer driver having a function of converting print data into a printer language corresponding to network printers 105 and 106 is installed. It is noted that the client computers 102 to 104 can register a plurality of printer drivers.

It is noted that in FIG. 1, a case is described as an example where the three client computers 102 to 104 are provided to the print management system. However, the number of the client computers is not limited to three, and any number of the client computers may be used as long as the number is one or above.

A print server 101 functioning as an example of a print management apparatus is composed of an information processing apparatus and connected via the network cable to the network 107. The print server 101 accumulates files used in the network 107 and monitors a use state of the network 107. The print server 101 manages the plurality of network printers 105 and 106 connected to the network 107.

It is noted that the client computers 102 to 104 and the print server 101 can be configured by storing print control programs for performing mutually different controls in general information processing apparatuses in an executable manner.

Also, in a case where a general information processing apparatus is used as the print server 101, the print server 101 can simultaneously have the functions of the client computers 102 to 104.

When the print server 101 receives print jobs including printing data from the client computers 102 to 104 and the print server 101 stores the print jobs in a storage medium and outputs the print jobs stored in the storage medium to the network printers 105 and 106 for printing. The print server 101 obtains various pieces of information related to the print jobs such as print results of the network printers 105 and 106 and job statuses and notifies the client computers 102 to 104 of the obtained various pieces of information.

The network printers 105 and 106 are connected to the network 107 via a network interface. When the print jobs including printing data are transmitted from the client computers 102 to 104, the network printers 105 and 106 analyze the print jobs and convert the printing data into a dot image for one page each, for example. Then, the network printers 105 and 106 print the printing data converted into the dot image for one page each, for example (execute the print jobs). Also, the network printers 105 and 106 can provide a management function for the print jobs to at least one of the print server 101 and the client computers 102 to 104. This management function for the print jobs may be regulated, for example, by ISO10175 (DPA: Document Printing Application).

It is noted that in FIG. 1, a case is exemplified in which the two network printers 105 and 106 are provided to the print management system. However, the number of the network printers is not limited to two, and any number of the network printers may be used as long as the number is one or above.

Also, as the network printers 105 and 106, for example, a printing apparatus may be provided that is adapted to perform printing through various methods such as a laser beam printer, an inkjet printer, and a digital multifunction device.

The network 107 is used for mutually connecting the client computers 102 to 104 and the print server 101, the network printers 105 and 106, and the like in a communicable manner. The network 107 may be realized, for example, by using the internet, a LAN (Local Area Network), or the like.

Figure 2:
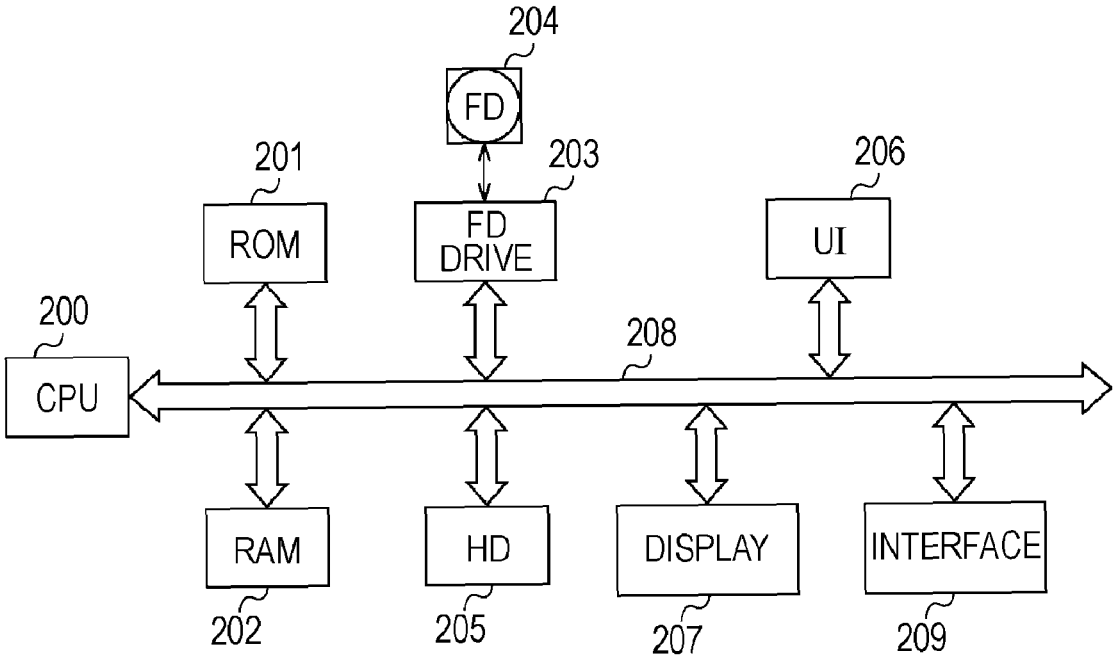
FIG. 2 is a block diagram of a configuration example of hardware in an information processing apparatus that can be utilized as a client computer and a printer server according to the first exemplary embodiment of the present invention.

FIG. 2 is a block diagram of a hardware configuration example in the information processing apparatus that can be used as the client computers 102 to 104 and the print server 101.

The client computers 102 to 104 and the print server 101 can be realized by information processing apparatuses having similar hardware configurations.

In FIG. 2, a CPU 200 constitutes a control unit of the information processing apparatus. The CPU 200 executes a program stored in a hard disk (HD) 205 or the like. The program executed by the CPU 200 can include, for example, one or more of an application program, a printer driver program, an OS (Operating System), and a network printer control program. Also, when the program is executed, the CPU 200 performs a control for temporarily storing information, files, and the like necessary for executing the program in a RAM 202.

The ROM 201 is a storage medium for storing a program such as for example a basis I/O program and various pieces of data such as font data and template data used for performing a document processing. The RAM 202 is a storage medium for temporarily storing data and functions as a main memory, a work area, or the like of the CPU 200.

A flexible disk (FD) drive 203 may be used for loading a program stored in a flexible disk (FD) 204 functioning as a storage medium onto the information processing apparatus. It is noted that the storage medium is not limited to the FD. For example, instead of the FD, an arbitrary storage medium such as one or more of a CD-ROM, a CD-R, a CD-RW, a PC card, a DVD, an IC memory card, MO, and a memory stick can be utilized.

The hard disk (HD) 205 may be one of the external storage media and may function as a large volume memory. The HD 205 can store at least one of the application program, the printer driver program, the OS, the network printer control program, an associated program, and the like. Also, a spooler may be stored in the HD 205. It is noted that a spooler refers to a client spooler in the client computers 102 to 104 and refers to a server spooler in the print server 101. Also, the print server 101 can store information on the received print job and a table for performing a control on a print order from the client computers 102 to 104 in the HD 205.

A UI (User Interface) 206 is a user interface for performing an instruction input performed by the user. To be more specific, the UI 206 may be provided with a key board and a mouse. The user can use the key board and the mouse provided to the UI 206 to instruct the information processing apparatuses (e.g., the client computers 102 to 104 and the print server 101) to input directions such as a control command to the network printers 105 and 106.

A display 207 displays the control command input from the UI 206, statuses of the network printers 105 and 106, and the like. The display 207 can be realized, for example, by using an LCD (Liquid Crystal Display). A system bus 208 is a transmission path for data in the information processing apparatuses (e.g., the client computers 102 to 104 and the print server 101). An interface 209 is used for connecting the information processing apparatuses (e.g., the client computers 102 to 104 and the print server 101) to the network 107. The information processing apparatuses (e.g., the client computers 102 to 104 and the print server 101) can perform exchange of data with an external apparatus via the interface 209.

Figure 3:
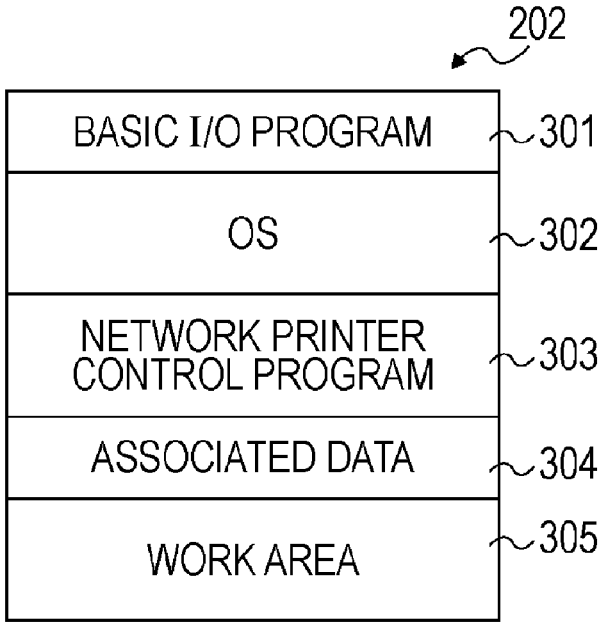
FIG. 3 illustrates a memory map example of a RAM illustrated in FIG. 2 according to the first exemplary embodiment of the present invention.

FIG. 3 illustrates a memory map example of the RAM 202 shown in FIG. 2.

The network printer control program stored in the FD 204 is loaded onto the RAM 202 to be put in an executable state. FIG. 3 illustrates the memory map in the executable state in the above-described manner.

In FIG. 3, when a power source of the information processing apparatus is turned ON, a basis I/O program 301 includes a program having an IPL (initial program loading) function of expanding the OS from the HD 205 onto the RAM 202 and starting the operation of the OS. An OS 302, a network printer control program 303 and associated data 304 are stored in areas respectively secured in the RAM 202. A work area 305 is an operation area used when the CPU 200 executes the network printer control program 303 or the like.

It is noted that according to the present embodiment, an example is described in which the network printer control program and the associated data is directly loaded from the FD 204 onto the RAM 202 for the execution, but the configuration is not necessarily limited to the above. For example, the network printer control program may be loaded onto the RAM 202 from the HD 205 in which the network printer control program has been already installed.

Also, the storage medium storing the network printer control program 303 is not limited to the FD 204, and for example, a CD-ROM, a CD-R, a PC card, a DVD, an IC memory card, or the like may also be used. Furthermore, the network printer control program 303 can be stored in the ROM 201, and this configuration may be regarded as a part of the memory map, so that the network printer control program 303 can also be directly executed by the CPU 200.

In addition, software and/or computer-executable instructions that realize similar functions of the above-described respective apparatuses can be configured as a substitute of the hardware apparatus.

It is noted that the print control program 303 includes a program for performing a control for the client computers 102 to 104 to instruct a print destination of the print job, for example. Also, the print control program 303 includes a program for the print server 101 to notify of a print ending of the print job, a print destination change request, or the like. In the following description, the network printer control program is referred to as print control program when applicable.

Figure 4:
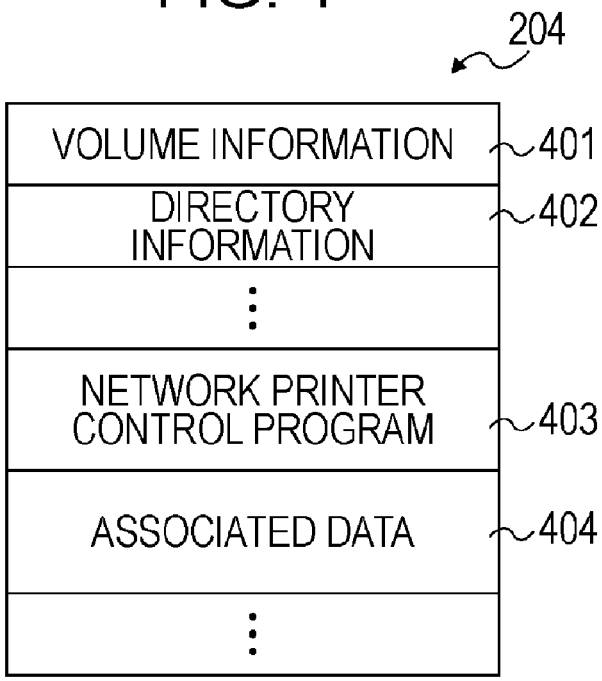
FIG. 4 illustrates a memory map example of an FD illustrated in FIG. 2 according to the first exemplary embodiment of the present invention.

FIG. 4 illustrates a memory map example of the FD 204 shown in FIG. 2.

In FIG. 4, the FD 204 stores volume information 401 representing information on data, directory information 402, a print control program 403 expanded into the RAM 202 as shown in FIG. 3, and associated data 404 of the print control program 403. The print control program 403 may be programmed on the basis of a flow chart and a time chart which will be described according to the present embodiment. The print control program 403 stored in the FD 204 is loaded onto the RAM 202 as the print control program 303 as shown in FIG. 3. It is noted that as described above, according to the present embodiment, for the client computers 102 to 104 and the print server 101, the same print control program 403 may be configured to be loaded onto the RAM 202.

Figure 5:
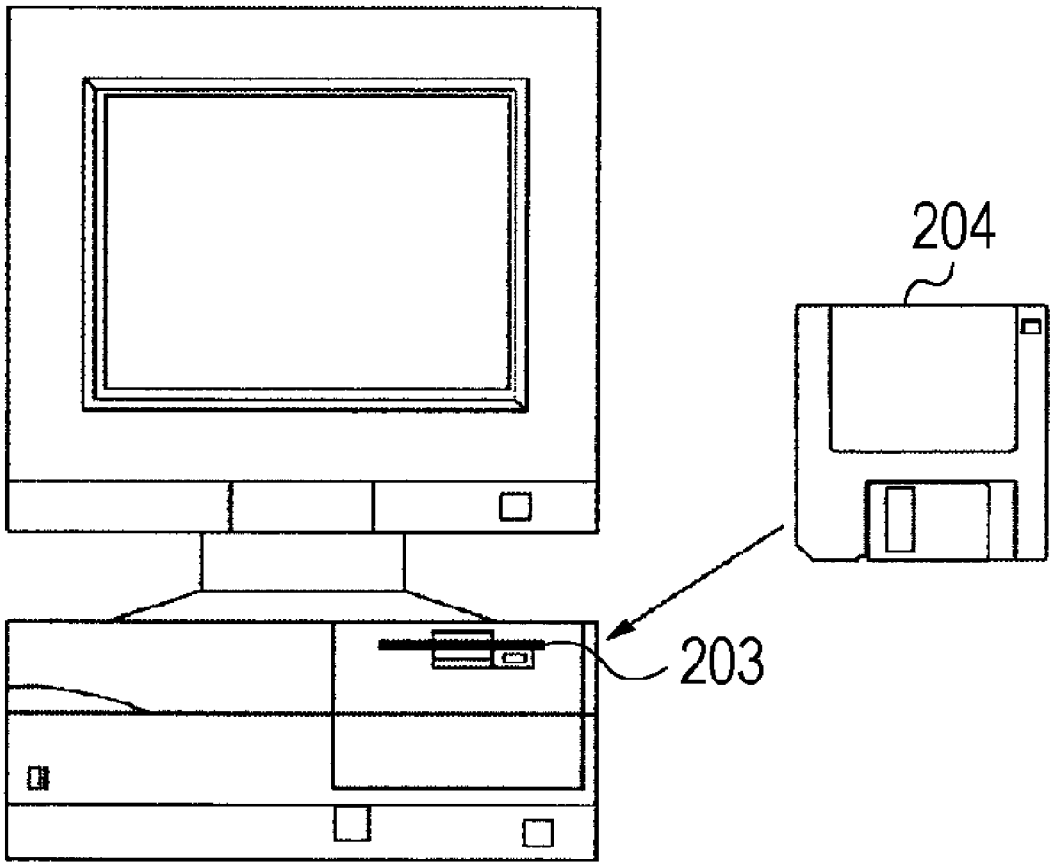
FIG. 5 illustrates an example of a relation between an FD drive and an FD that is inserted into the FD drive according to the first exemplary embodiment of the present invention.

FIG. 5 illustrates a relation between the FD drive 203 and the FD 204 inserted into the FD drive 203. In FIG. 5, the FD 204 stores the print control program 403, the associated data 404, and the like programmed on the basis of the flow chart and the time chart to be described according to the present embodiment.

Figure 6:
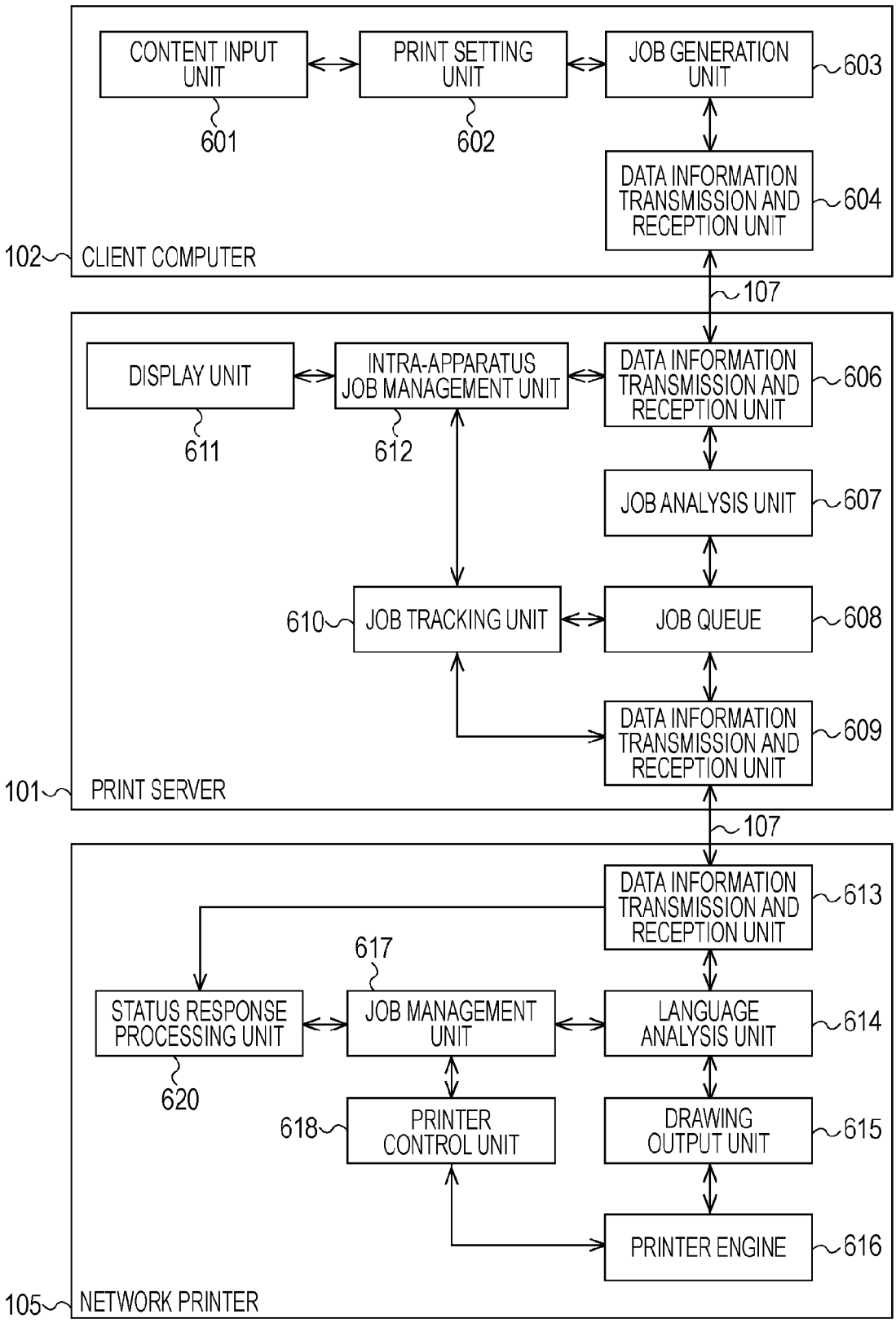
FIG. 6 is a block diagram of functional configuration examples of a print server, a client computer, and a network printer according to the first exemplary embodiment of the present invention.

FIG. 6 is a block diagram of functional configuration examples of the print server 101, the client computer 102, and the network printer 105. It is noted that the client computers 103 and 104 have the same configuration as the client computer 102, and the network printer 106 has the same configuration as the network printer 105. Therefore, in the following description, the client computer 102 and the network printer 105 will be explained, and an explanation on the client computers 103 and 104 and the network printer 105 will be omitted.

Client Computer 102

A content input unit 601 has a function of inputting a print content such as text data or PDF data.

A print setting unit 602 has a function of setting a page to which a clear toner page is applied as a print instruction to a print job. Herein, the clear toner page refers, for example, to a page where clear toner is developed and fixed on a paper surface on which colored toner has been printed (i.e., where print is performed by using the clear toner). Also, the print setting unit 602 has a function of bookbinding printing, stapling, punching, setting the number of prints, and the like. It is noted that the print setting unit 602 displays a print setting GUI on the display 207, for example, at a timing when the print content is input to the content input unit 601. On the basis of the operation result of the user on the print setting GUI, the print setting unit 602 can perform the above-described setting.

A job generation unit 603 generates a print job on the basis of the print content accepted by the content input unit 601 and print instruction information representing the content set by the print setting unit 602.

A data information transmission and reception unit 604 has a function of transmitting and receiving transmission data to the print server 101 and the reception data via the print server 101 from the network printer 105 via the network 107.

Print Server 101

A data information transmission and reception unit 606 has a function of transmitting and receiving the transmission data to the client computer 102 and the reception data from the client computer 102 via the network 107.

A job analysis unit 607 accepts the print job transmitted via the data information transmission and reception unit 606 from the client computer 102. Then, the job analysis unit 607 analyzes the received print job to generate a plurality of jobs in accordance with print instruction information obtained from the print job. Then, the job analysis unit 607 saves the plurality of generated jobs and the like in a job queue 608.

When necessary, the job queue 608 performs scheduling for processing the jobs. Also, the job queue 608 has a function of a spooler and transmits the received jobs via a data information transmission and reception unit 609 to the network printer 105.

The data information transmission and reception unit 609 has a function of transmitting and receiving the transmission data to the network printer 105 and the reception data from the network printer 105 via the network 107.

An intra-apparatus job management unit 612 has a function of obtaining and caching the print job in the print jobs in the network printer 105 to be supplied to a display unit 611. Also, the intra-apparatus job management unit 612 has a function of receiving the instruction based on the operation result of the user on the GUI displayed on the display unit 611 and transmitting control commands such as cancelling and stopping of the print job via the data information transmission and reception unit 609 to the network printer 105.

A job tracking unit 610 tracks the print job executed (i.e., printed) by the network printer 105 or the print job cached by the intra-apparatus job management unit 612 from the job queue 608.

Network Printer 105

A data information transmission and reception unit 613 has a function of transmitting and receiving the transmission data to the network printer 105 and the reception data from the network printer 105 via the network 107. The data information transmission and reception unit 613 receives data on the print job and an attribute of the print job, for example, from the print server 101, for the management.

A language analysis unit 614 analyzes the content of the data on the print job in detail to decode a print order and executes the control command related to the management on the print job, the drawing output, and the like while following the print order. For example, the language analysis unit 614 receives the control command one by one in sequence among the control command group from the reception buffer in the data information transmission and reception unit 613 to investigate the content while following the description rule of the printer control language and determines which processing the control command demands.

As a result of this determination, in a case where the control command is a command related to the print job or a command related to the attribute of the print job, the language analysis unit 614 issues a management order on the relevant print job to the job management unit 617. It is noted that the command related to the print job may be, for example, at least one of a start declaration, an end declaration, and the like of the print job. Also, the command related to the attribute of the print job may be, for example, at least one of the sheet size, the number of pages, stapling, punching, and the like.

Furthermore, in a case where the control command is for instructing the drawing output such as one or more of a character, a figure, and an image, the language analysis unit 614 performs the drawing output command based on the relevant print job to a drawing output unit 615.

A job management unit 617 issues a selection command on a sheet to be used and a paper ejection bin (printer control command) to a printer control unit 618 in accordance with the attribute of the print job to be executed. Furthermore, by obtaining the status of the network printer 105 via the printer control unit 618, the job management unit 617 regularly monitors the status of the print job which is being executed. Then, the job management unit 617 instructs a status response request on a status response processing unit 620 when a predetermined condition is established in which the job is ended or an error is generated, for example.

The drawing output unit 615 has a function of carrying out the drawing development for performing the print output such as one or more of a character, a figure, and an image for the output. For example, while following the drawing output command from the language analysis unit 614, the drawing output unit 615 may perform a creation of one or more of the relevant character pattern, a calculation of the figure, a development processing of the image data, and the like to develop the print data in a data format suitable to the output and transmits the print data to an printer engine 616.

The printer engine 616 uses, for example, an electronic photography method while following the print data converted in a data format suitable to the output by the drawing output unit 615 (output development data) to perform the print output processing by actually forming the image on the paper surface.

In addition, the printer engine 616 has a remaining amount detection unit for the recording paper. The printer engine 616 regularly transmits a warning signal to the printer control unit 618 in a case where the sheet is not set. In addition, in a case where the sheet does not exist when the development and print processing is to be performed, the printer engine 616 stops the recording unit such as a printer drum and transmits an error signal to the printer control unit 618 by way of interruption or the like.

While following the printer control command from the job management unit 617, for example, the printer control unit 618 has a function of performing a control on the network printer 105 by performing selection for a sheet to be used, initialization for the network printer 105, or the like. Also, the printer control unit 618 regularly monitors information on a sheet feed cassette used when the print is executed, executed finishing information such as one or more of bookbinding, punching, stapling, and saddling (i.e., finishing processing), information on the paper ejection port from which the paper is ejected, and sheet conveyance path information on the presence or absence of the use of the reverse path or the lie.

Furthermore, the printer control unit 618 also has a function of notifying of a print result at the time of job completion when necessary.

It is noted that the above-described information is saved in a memory provided to the printer control unit 618.

While following the status response request instruction received from the job management unit 617, the status response processing unit 620 converts the status notification represented in an internal format of the network printer 105 into an external representation which can be understood by the print server 101 to create status response information. Then, the status response processing unit 620 transmits this status response information to the data information transmission and reception unit 613.

When status response information is received from the status response processing unit 620, the data information transmission and reception unit 613 temporarily accumulates the status response information in a transmission buffer or the like and transmits the accumulated status response information via the network 107 to the print server 101.

Figure 7:
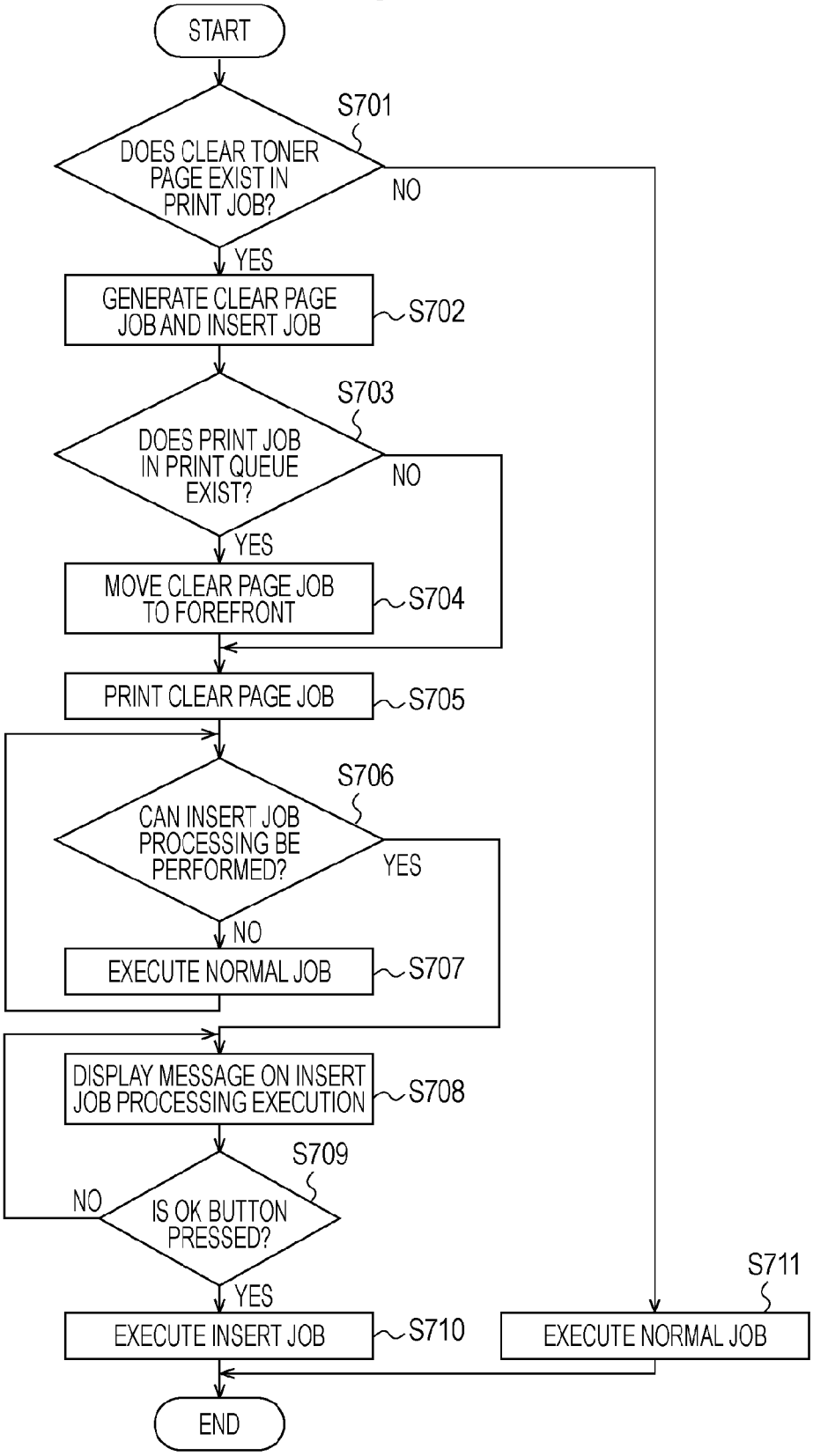
FIG. 7 is a flow chart for describing an example of a processing operation performed by the print server according to the first exemplary embodiment of the present invention.

FIG. 7 is a flow chart for describing a processing operation example performed by the print server 101.

First, in step S701, the job analysis unit 607 reads the print instruction information obtained from the print job which is transmitted from the client computer 102 to determine whether the setting related to the clear toner page exists in the print instruction information. FIG. 8 illustrates an example of print instruction information (e.g., a job ticket) in which the clear toner pages are specified as pages 2 to 7 and pages 9 to 13.

As a result of this determination, in a case where the setting related to the clear toner page does not exist in the print instruction information (NO in steps S701), the flow advances to step S711, where processing of the print job functioning as a normal print job is executed, and processing may then be ended.

On the other hand, in a case where the setting related to the clear toner page exists in the print instruction information (YES in step S701), the flow advances to step S702. When the flow advances to step S702, the job analysis unit 607 generates two jobs including the clear page job and the insert job. Herein, according to the present embodiment, the clear page job refers to a job in which only a page on which the clear toner is used among a plurality of pages in one print job (clear page) is printed (in FIG. 8, pages 2 to 7 and pages 9 to 13 are equivalent to the clear pages). Also, the insert job refers to a job in which a remaining page (insert page) is printed while the printed clear toner page is fed (in FIG. 8, pages 1 and 8 and the like are equivalent to the insert pages).

Figure 9:
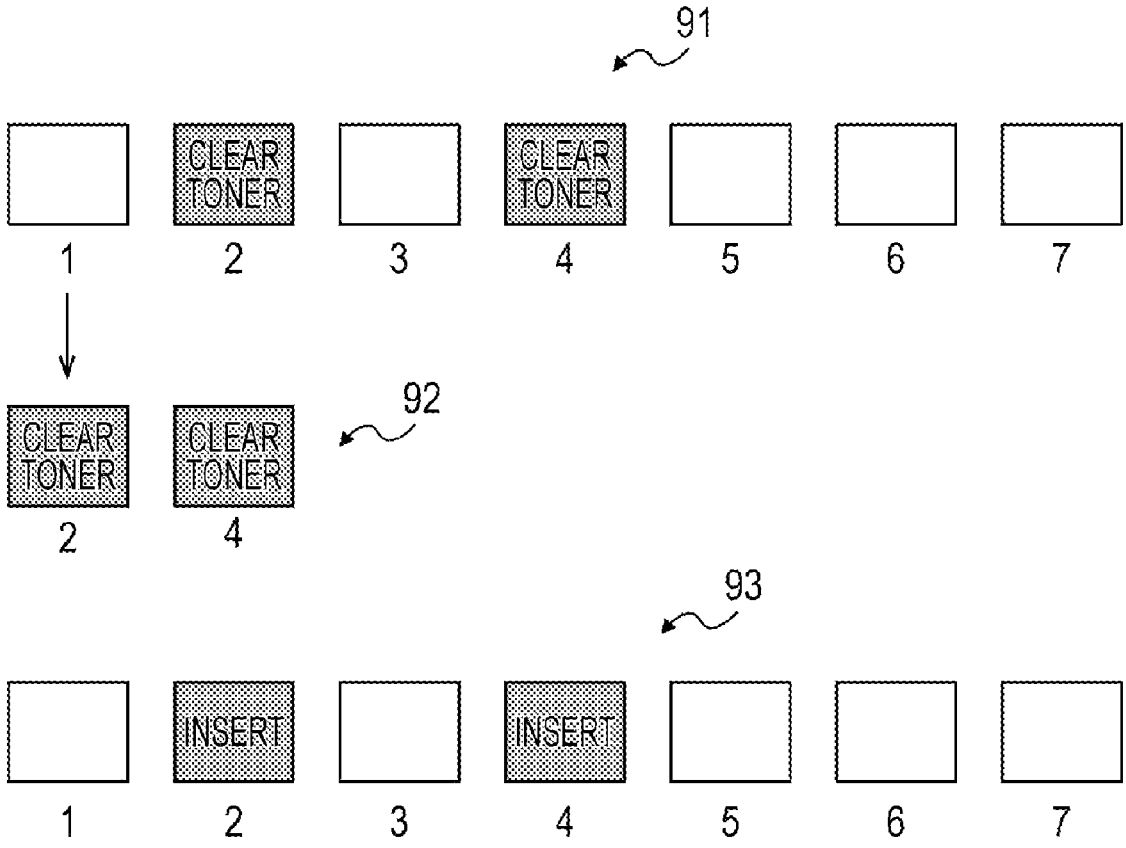
FIG. 9 is a conception diagram of an example of a job structure to be generated according to the first exemplary embodiment of the present invention.

FIG. 9 is a conception diagram of an example of a job structure to be generated.

As illustrated in FIG. 9, in a case where the instruction of the clear toner page exists in pages 2 and 4 of an input print job 91, a clear page job 92 is generated for only printing of the pages 2 and 4 of the print job 91. Herein, the clear page job 92 can be generated by specifying the print page range in the print instruction information.

On the other hand, when an insert job 93 is executed, the pages 2 and 4 corresponding to the clear toner pages are fed from a desired sheet feeding port of the network printer 105. After that, regarding the fed sheet, without printing the content, only the clear toner is used, and the print for the second time is performed. At this time, the remaining pages other than the clear toner pages (in FIG. 9, the pages 1, 3, and 5 to 7) are printed. Then, the sheet on which the print for the second time is performed by only using the clear toner is inserted into the pages 2 and 4 of the print job 91, and the respective pages of the print job 91 are ejected. Herein, the insert job 93 can be generated, for example, by specifying "no content print" and "the clear toner print" with respect to the print attribute of the relevant page.

As described above, according to the present embodiment, for example, an example of the clear page print job is realized by way of the clear page job, and the insert print job is realized by way of the insert job. Then, for example, by performing the processing in step S702, an example of a generation unit is realized.

While returning to the description on FIG. 7, the flow advances to step S703, the job analysis unit 607 determines whether the print job in the print queue (stand-by print job) exists in the job queue 608. In the above-described manner, according to the present embodiment, for example, by performing the processing in step S703, an example of a second determination unit may be realized.

As a result of this determination, in a case where the print job in the print queue does not exist (NO in step S703), the processing flow skips step S704 and advances to step S705.

On the other hand, in a case where the print job in the print queue exists (YES in step S703), the processing flow advances to step S704, the job queue 608 moves the clear page job generated in step S702 to the forefront of the print job in the print queue. It is noted that in a case where the clear page job is already in the print queue, the job queue 608 registers the clear page job generated in step S702 before the forefront of the print page job in the print queue.

Then, when the flow advances to step S705, the job queue 608 instructs the data information transmission and reception unit 609 to transmit the clear page job to the network printer specified by the user (for example, the network printer 105). With this configuration, the clear page job is executed, and the print based on the colored toner is performed (in this stage, the print using the clear toner is not executed).

As described above, according to the present embodiment, for example, by performing the processing in steps S704 and S705, an example of a first instruction unit may be realized.

Next, in step S706, the job queue 608 determines whether the processing on the insert job can be performed. In the present step, it is determined whether the clear page job printed in step S705 occurs after a job resting time has elapsed. Herein, if the clear toner is not borne after the heat on the sheet is cooled down, air bubbles or cracks may be caused, and thus the printed product may need to be cooled down. The job resting time refers to a predetermined period of time that may be necessary for cooling down this printed product. This job resting time may be affected by a room temperature, a shape of media, a basis weight, and the like. Also, according to the present embodiment, the user may previously store (set) the job resting time in the storage medium of the print server 101 (the HD 205 or the like).

As a result of the determination in step S706, in a case where the job resting time has elapsed and the insert job can be performed (YES in step S706), the processing flow advances to step S708. In a case where the job resting time has not elapsed and the insert job cannot be performed (NO in step S706), the processing flow advances to step S707.

When the flow advances to step S707, the job queue 608 instructs the data information transmission and reception unit 609 to perform the transmission of the print job which is the print job other than the clear page job and the insert job among the print jobs in the print queue and which is located at the forefront. When the processing is performed on one print job in step S707, the flow is returned to step S706. With this configuration, the normal print job piled up in the spooler may be executed one by one. In the above-described manner, according to the present embodiment, for example, by performing the processing in step S707, an example of a third instruction unit may be realized.

Figure 10:
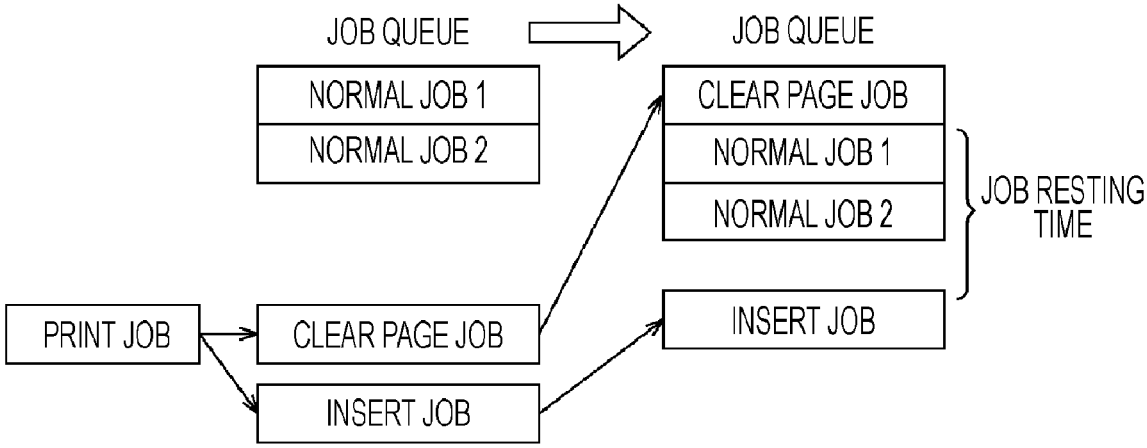
FIG. 10 illustrates an example of a situation where print jobs are shifted in a job queue according to the first exemplary embodiment of the present invention.

FIG. 10 illustrates an example of a situation where print jobs are shifted in the job queue 608. From the print job, the clear page job and the insert job are generated and stored in the job queue. At this time, the clear page job is stored at a position where the processing is performed earlier than normal jobs 1 and 2 already stored in the job queue, and the insert job is stored after the normal jobs.

Herein, in a case where the actual printing is performed, the job queue 608 first instructs the print of the clear page job and instructs the print of the normal job when the job resting time has elapsed. For example, in a case where the job resting time elapses during the print of the normal job 1, the job queue 608 instructs the print of the insert job before the print of the normal job 2 is instructed.

On the other hand, when the flow advances to step S708, the display unit 611 displays the insert job processing execution message (GUI). Before the insert job is executed, the user may need to set the printed product from the clear page job to the sheet feeding port of the network printer. In the present step, a message is displayed, and the user is urged to perform the specification of the sheet feeding port to which the printed product is set and the pressing of the print execution button. In the above-described manner, according to the present embodiment, for example, by performing the processing in step S708, an example of a notification unit may be realized.

Next, in step S709, the job queue 608 determines whether the user has pressed the print execution button included in "the insert job processing execution message (GUI)" displayed in step S708. As a result of this determination, in a case where the print execution button is not pressed (NO in step S709), the processing flow is returned to step S708. On the other hand, in a case where the print execution button is pressed (YES in step S709), the processing flow advances to step S710. It is noted that it may suffice if the user instructs the processing on the insert job in one of the client computer 102, the print server 101, and the network printer 105.

When the flow advances to step S710, the job queue 608 instructs the data information transmission and reception unit 609 to transmit the insert job. With this configuration, regarding the clear toner page, while following the insert job generated in step S702, the sheet is fed from the sheet feeding port specified in step S708. After only the clear toner is printed, the sheet is inserted into the specific page and then ejected. On the other hand, regarding the other pages, while following the insert job generated in step S702, the content is printed, and the sheet is ejected. In the above-described manner, according to the present embodiment, for example, by performing the processing in step S710, an example of a second instruction unit may be realized. Processing may then be ended.

As described above, according to the present embodiment, the print job including the clear toner page is divided into the clear page job and the insert job, and the jobs are linked to each other. Then, the clear page job is executed in priority to the other print jobs, and the page is obtained on which the print based on the colored toner is performed. After that, when the job resting time elapses, the processing of the insert job is executed. The print based on the clear toner is carried out on the page on which the print based on the colored toner is performed, and also the print is performed on the other pages. Then, the page on which the print based on the clear toner is performed is inserted between other pages while following the content of the insert job. Therefore, it is possible to obtain the resultant product without rearranging the printed products by the user. Thus, the post-processing may be alleviated, and the efficiency in the processing can be promoted. Also, the sheet set again into the network printer when the insert job is executed may be limited to the clear toner page, and thus the operational load of the user can be alleviated as compared with the related art.

Next, a second exemplary embodiment of the present invention will be described. According to the above-described first exemplary embodiment, during the job resting time, only the normal print job can be performed. In contrast, according to the present embodiment, during the job resting time, the insert job is executed in a case where the finishing processing is set for the print job. In this way, as the present embodiment is compared with the above-described first exemplary embodiment, a part of the processing is different when the print job is performed. Thus, in the description of the present embodiment, similar configurations to those of the above-described first exemplary embodiment 1 are denoted by the same reference given to FIGS. 1 to 10, for example, and a detailed description thereof will be omitted.

Figure 11:
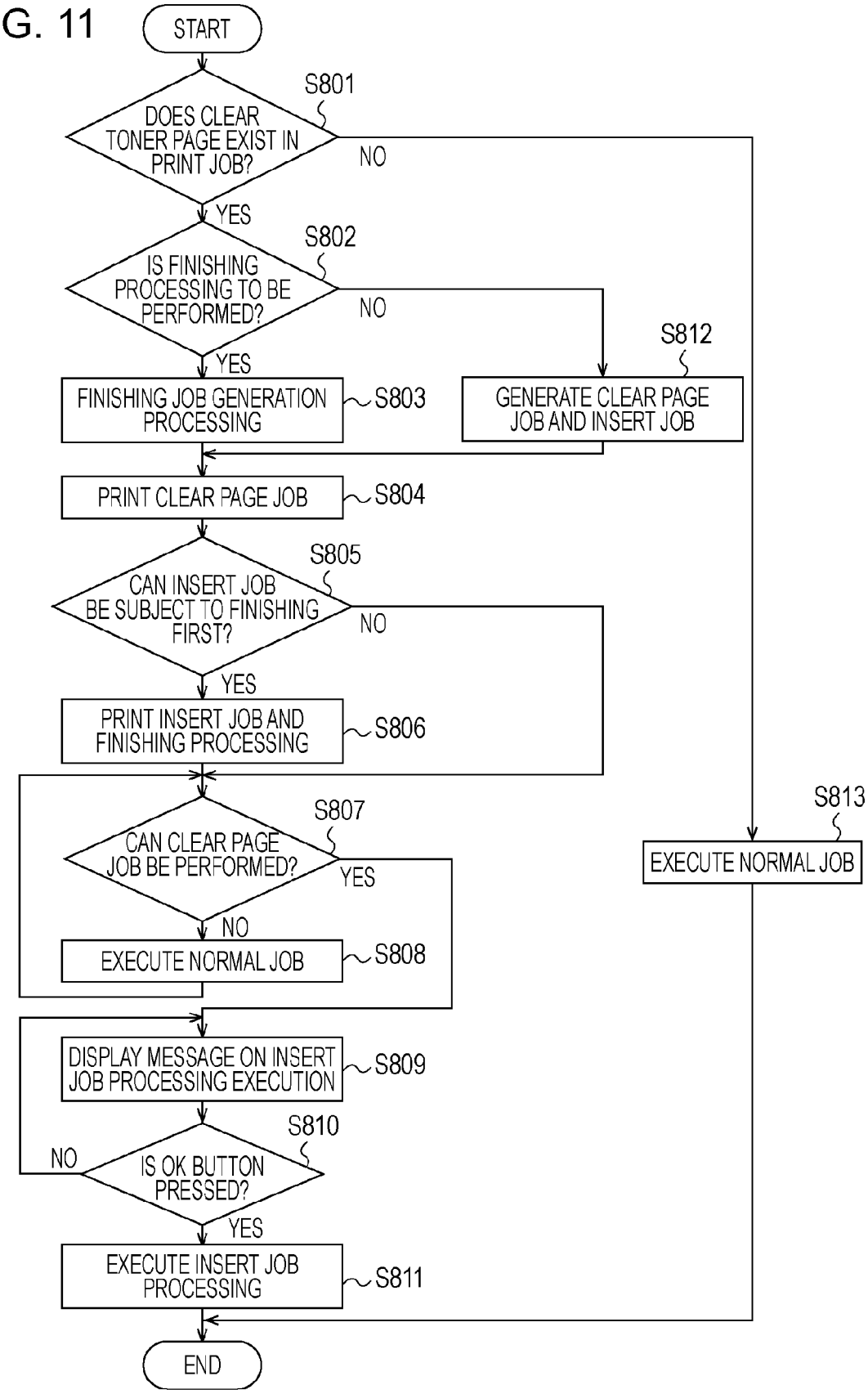
FIG. 11 is a flow chart for describing an example of a processing operation performed by a print server according to a second exemplary embodiment of the present invention.

FIG. 11 is a flow chart for describing an example of a processing operation in the print server 101.

First, in step S801, the job analysis unit 607 reads the print instruction information obtained from the print job which is transmitted from the client computer 102 to determine whether the setting related to the clear page exists in the print instruction information. As a result of this determination, in a case where the setting related to the clear page does not exist in the print instruction information (NO in step S801), the processing flow advances to step S813, the processing of the print job functioning as a normal print job is executed, and processing may be ended.

On the other hand, in a case where the setting related to the clear page exists in the print instruction information (YES in step S801), the processing flow advances to step S802. When the flow advances to step S802, the job analysis unit 607 determines whether the information related to the finishing processing exists in the print instruction information. As a result of this determination, in a case where the information related to the finishing processing exists in the print instruction information (YES in step S802), the flow advances to step S803, and in a case where the information related to the finishing processing does not exist in the print instruction information (NO in step S802), the flow advances to step S812. In step S812, similarly to step S702 of FIG. 7, two jobs including the clear page job and the insert job are generated, and processing proceeds to step S804.

In step S803, the finishing job generation processing is executed, and processing proceeds to step S804.

Figure 12:
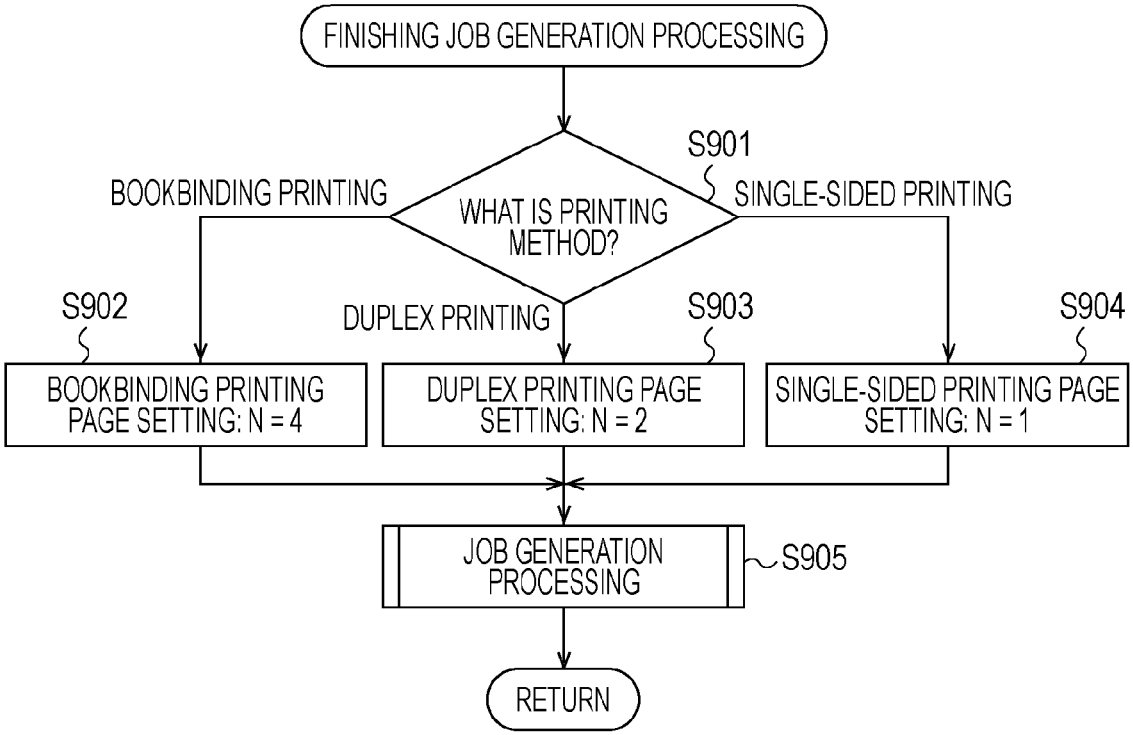
FIG. 12 is a flow chart for describing an example of a finishing job generation processing in step S803 in detail according to the second exemplary embodiment of the present invention.

FIG. 12 is a flow chart for describing an example of the finishing job generation processing in step S803 in detail.

In the finishing job generation processing, first, in step S901, the job analysis unit 607 determines the print method on the basis of the print instruction information or the like. Herein, the printing method is supposed to be one of the bookbinding printing, the duplex printing, and the single-sided printing. Then, in a case where the printing method is the bookbinding printing, the duplex printing, and the single-sided printing, the processing is branched to steps S902, S903, and S904, respectively. In steps S902, S903, and S904, the job analysis unit 607 sets, in accordance with the print method, a variable N representing the number of content pages to be printed on one sheet as "4", "2", and "1", respectively.

Then, the flow advances to step S905, and the job generation processing is performed.

Figure 13:
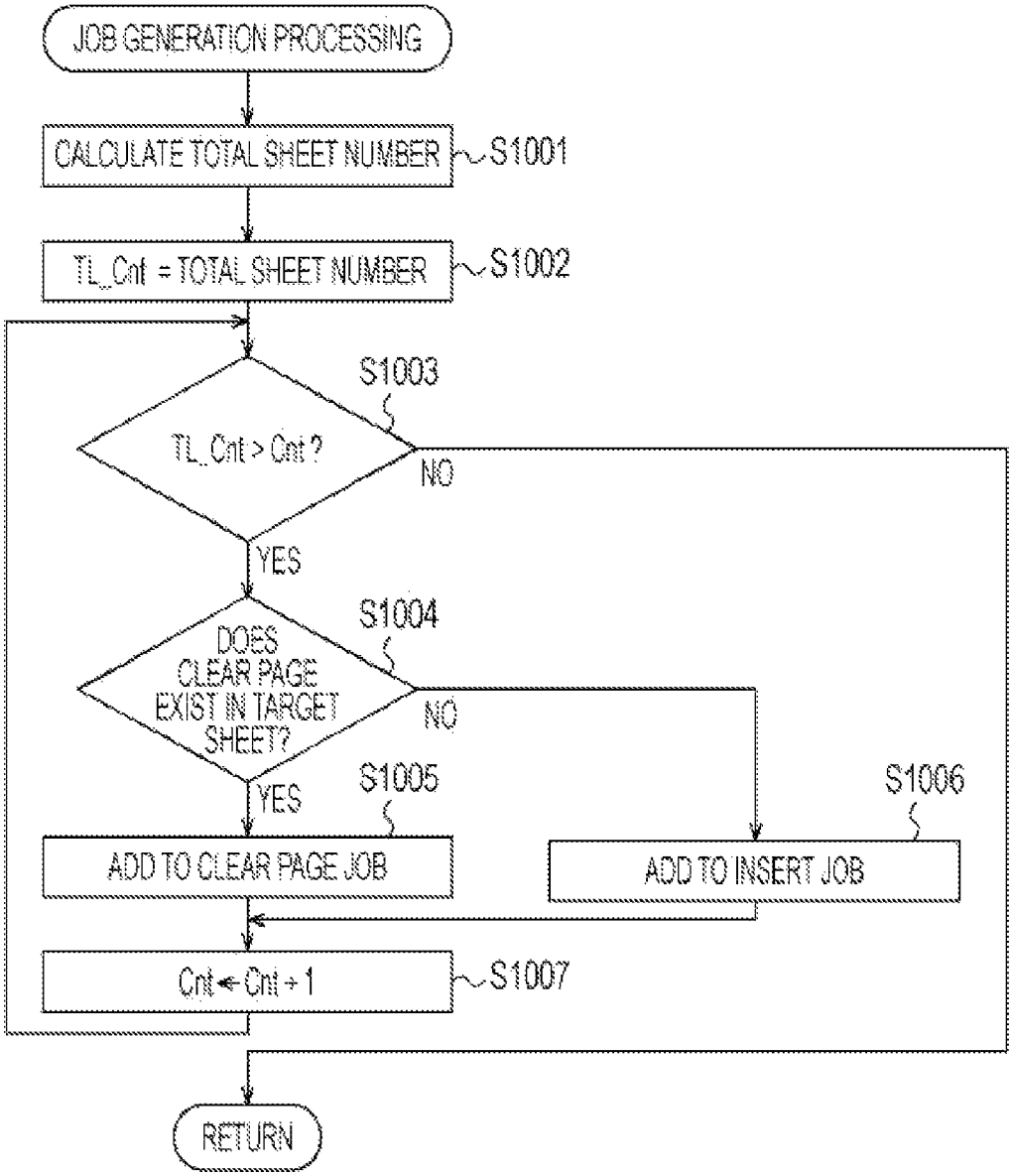
FIG. 13 is a flow chart for describing an example of a job generation processing in step S905 in detail according to the second exemplary embodiment of the present invention.

FIG. 13 is a flow chart for describing an example of the job generation processing in step S905 in detail.

In the job generation processing, first, in step S1001, the job analysis unit 607 calculates a total sheet number on the basis of the total number of pages of the print content and the variable N set in steps S902, S903, and S904 of FIG. 12. Herein, the total sheet number can be calculated, for example, by the following expression (1).

$$\text{Total sheet number}=\text{Total content page number}/N \quad (1)$$

It is noted that fractions of the value obtained through the expression (1) is calculated as one.

Next, in step S1002, the job analysis unit 607 sets the total sheet number calculated in step S1001 as a variable TL_Cnt and initializes a counter Cnt as 0. Next, in step S1003, the job analysis unit 607 determines whether the value of the variable TL_Cnt is larger than the value of the counter Cnt to determine whether the checking is ended for all the sheets. As a result of this determination, in a case where the value of the variable TL_Cnt is smaller than the value of the counter Cnt and the checking is ended for all the sheet (NO in step S1003), the flow advances to step S804 of FIG. 11.

On the other hand, in a case where the value of the variable TL_Cnt is larger than the value of the counter Cnt and the checking is not ended for all the sheet (YES in step S1003, the flow advances to step S1004. When the flow advances to step S1004, the job analysis unit 607 determines whether the setting related to the clear page exists with respect to the target sheet (i.e., the sheet identified by the value of the counter Cnt).

Figure 14:
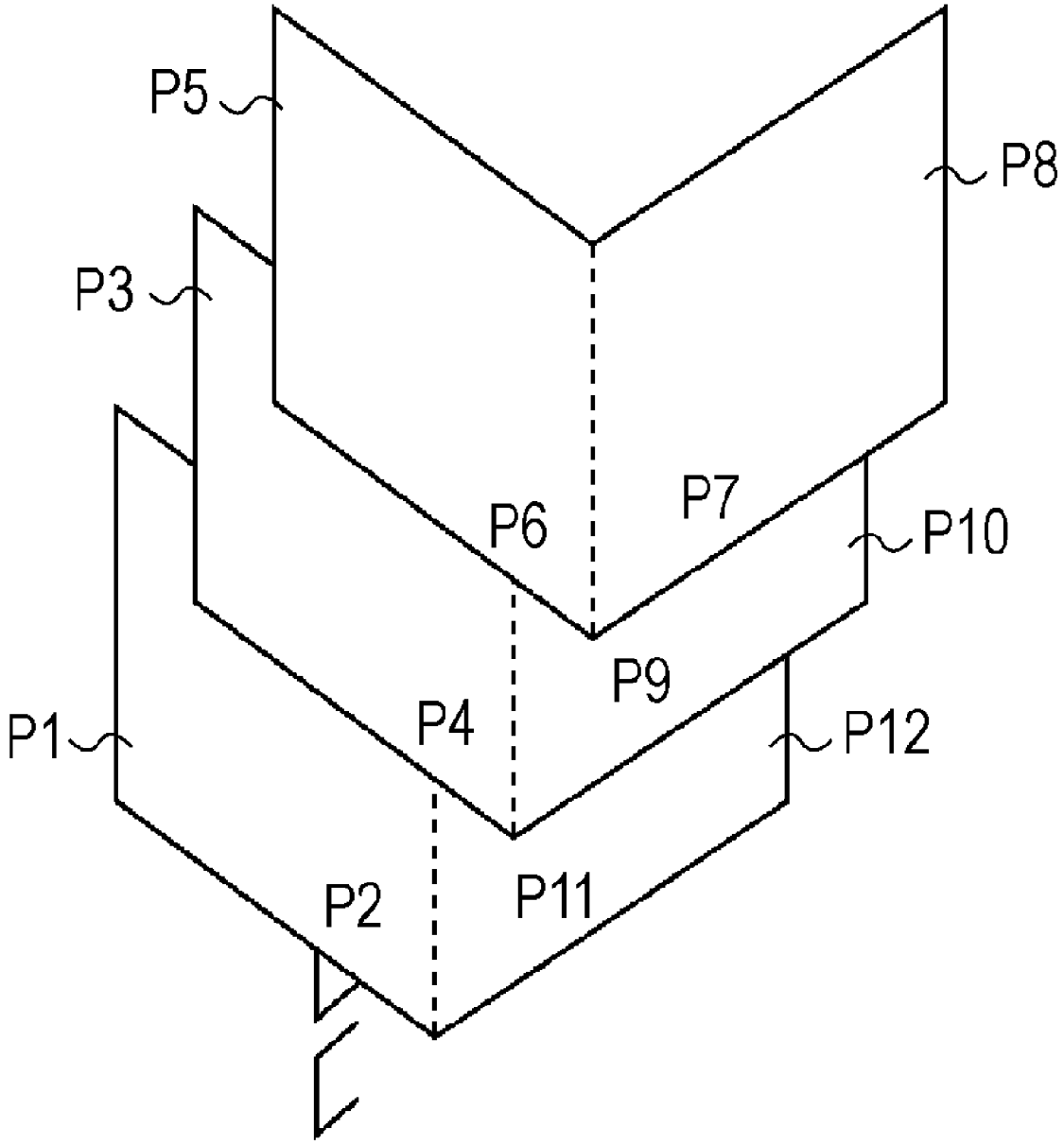
FIG. 14 illustrates a printed product example which is subjected to a bookbinding printing according to the second exemplary embodiment of the present invention.

FIG. 14 illustrates an example of a printed product subjected to the bookbinding printing.

In the bookbinding printing illustrated in FIG. 14 for obtaining the printed product, four content pages exist with respect to one sheet as follows.

Sheet 1; P1, P2, P11, P12

Sheet 2; P3, P4, P9, P10

Sheet 3; P5, P6, P7, P8

In a case where the setting of the clear toner page exists even for one page among the pages constituting the sheet, for example, in a case when the page P3 is the clear toner page, the job analysis unit 607 determines that the sheet 2 has the clear page.

As a result of the determination in step S1004, in a case where the setting related to the clear page exists with respect to the target sheet (YES in step S1004), the flow advances to step S1005, and the job analysis unit 607 adds the relevant sheet to the clear page job.

On the other hand, in a case where the setting related to the clear page does not exist with respect to the target sheet (i.e., the sheet identified by the value of the counter Cnt) (NO in step S1004), the processing flow advances to step S1006, and the job analysis unit 607 adds the relevant sheet to the insert job.

Then, when the flow advances to step S1007, the job analysis unit 607 increments the value of the counter Cnt, and the processing flow may return to step S1003.

Through the above-described steps, the clear page job and the insert job may be generated. As described above, according to the present embodiment, for example, by performing the processing in steps S803 and S812, an example of the generation unit may be realized.

While returning to the description of FIG. 11, in step S804, similarly to step S705, the job queue 608 instructs the data information transmission and reception unit 609 to transmit the clear page job to the network printer specified by the user. With this configuration, the clear page job is executed, and the print based on the colored toner is performed. In the above-described manner, according to the present embodiment, for example, by performing the processing in step S804, an example of a first instruction unit may be realized.

Next, in step S805, the job queue 608 determines whether the insert job can be subjected to the finishing processing as a precedent job. For example, in a case where an instruction is issued of performing separate bookbinding on the print job as the finishing processing, the job queue 608 determines that only the insert job can be subjected to the finishing processing as the precedent job. Herein, the separate bookbinding refers to a method of generating a plurality of books from one document and generating one book by overlapping these books. There is an upper limit on the number of sheets that can be subjected to the bookbinding in the device (e.g., the network printer). In a case where the contents exceeding the upper limit is to be printed, the situation may be coped with using this separate bookbinding.

It is noted that the above-described determination may be a principle. In a case where the number of sheets for the insert job is equal to or less than the number of sheets that can be subjected to the finishing processing (one sheet in the bookbinding printing), the job queue 608 determines that the insert job cannot be subjected to the finishing processing as the precedent job. Also, when the separate bookbinding is performed with only the insert job, in a case where the number of sheets of the clear page job is equal or smaller than the number of sheets that can be subjected to the finishing processing, the job queue 608 determines that the insert job cannot be subjected to the finishing processing as the precedent job.

Herein, the user can set the number of sheets that can be subjected to the finishing processing.

As a result of the determination in steps S805 described above, in a case where the insert job cannot be subjected to the finishing processing as the precedent job (NO in step S805), the processing flow skips step S806 and advances to step S807.

On the other hand, in a case where the insert job can be subjected to the finishing processing as the precedent job (YES in step S805), the processing flow advances to step S806. When the flow advances to step S806, the job queue 608 instructs the data information transmission and reception unit 609 to transmit the insert job and the information representing the execution content of the finishing processing. With this configuration, the print of the insert job and the finishing processing are performed. In the present step, the job queue 608 checks whether the number of sheets does not exceed the upper limit number of sheets that can be subjected to the finishing processing, and then decides the execution content of the finishing processing.

It is noted that in a case where the number of sheets exceeds the upper limit number of sheets that can be subjected to the finishing processing, the job analysis unit 607 divides the insert job to generate a job constituted by the number of sheets within the upper limit (the number of sheets that can be subjected to the finishing processing). Herein, in a case where the number of sheets of the insert job after the division is equal to or smaller than the number of sheets that can be subjected to the finishing processing, the job analysis unit 607 generates a job as the insert job including the clear toner page. Regarding such a job, the processing in step S806 is not executed.

As described above, according to the present embodiment, for example, by performing the processing in step S806, an example of a fourth instruction unit may be realized.

Next, in step S807, the job queue 608 determines whether the processing on the insert job can be performed. In the present step, it is determined whether the clear page job printed in step S705 the job resting period of time has elapsed.

As a result of this determination, in a case where the job resting time has elapsed and the insert job can be performed (YES in step S807), the flow advances to step S809, and in a case where the job resting time does not elapse and the insert job cannot be performed (NO in step S807), the flow advances to step S808.

When the flow advances to step S808, the job queue 608 instructs the data information transmission and reception unit 609 to perform the transmission of the print job which is the print job other than the clear page job and the insert job among the print jobs in the print queue and which is located at the forefront. When the processing is performed on one print job, the flow is returned to step S807. With this configuration, the normal print job piled up in the spooler may be executed one by one.

In the above-described manner, according to the present embodiment, for example, by performing the processing in step S808, an example of the third instruction unit may be realized.

On the other hand, when the flow advances to step S809, the display unit 611 displays the insert job processing execution message (GUI), and urges the user to perform the specification of the sheet feeding port to which the printed product is set and pressing of the print execution button. In the above-described manner, according to the present embodiment, for example, by performing the processing in step S809, an example of the notification unit may be realized.

Next, in step S810, the job queue 608 determines whether the user presses the print execution button included in "the insert job processing execution message (GUI)" displayed in step S809. As a result of this determination, in a case where the print execution button is not pressed (NO in step S810), the processing flow is returned to step S809. On the other hand, in a case where the print execution button is pressed (YES in step S810), the processing flow advances to step S811.

When the flow advances to step S811, the job queue 608 instructs the data information transmission and reception unit 609 to transmit the insert job. With this configuration, regarding the clear toner page, in step S803, while following the insert job generated in step S812, the sheet is fed from the sheet feeding port specified in step S809. After only the clear toner is printed, the sheet is inserted into the specified page and then ejected. On the other hand, regarding the other pages, while following the insert job generated in step S812, the content is printed, and the sheet is ejected. In the above-described manner, according to the present embodiment, for example, by performing the processing in step S811, an example of the second instruction unit may be realized. Processing may then be ended.

As described above, according to the present embodiment, in a case where the finishing processing is set to be executed on the print job and the insert job can be subjected to the finishing processing earlier than the clear toner page, during the job resting time, the insert job is executed. As an example thereof, in a case where one book is generated by overlapping books obtained by folding, for example, three printed products into half, the second book does not include the clear page. In this case, according to the present embodiment, the print and the finishing processing can be executed on the second book earlier. Therefore, it is possible to shorten the waiting time until the resultant product is obtained, and the operation efficiency in the print using the clear toner can be improved.

It is noted that according to the present embodiment too, similarly to the first exemplary embodiment, for example, between the steps S812 and step S804 of FIG. 11, the processing in steps S703 and S704 of FIG. 7 may be performed.

Next, a third exemplary embodiment of the present invention will be described. According to the above-described first exemplary embodiment, the processing is performed without taking into account the sheet size of the clear page job and the media. In contrast, according to the present embodiment, the processing is performed while taking into account the sheet size of the clear page job and the media. In this way, between the present embodiment and the above-described first exemplary embodiment, a part of the processing is different when the print job is performed. Thus, in the description of the present embodiment, similar configuration to those of the above-described first exemplary embodiment are assigned with the same reference numerals given in FIGS. 1 to 10, for example, and a detailed description thereof will be omitted.

Figure 15:
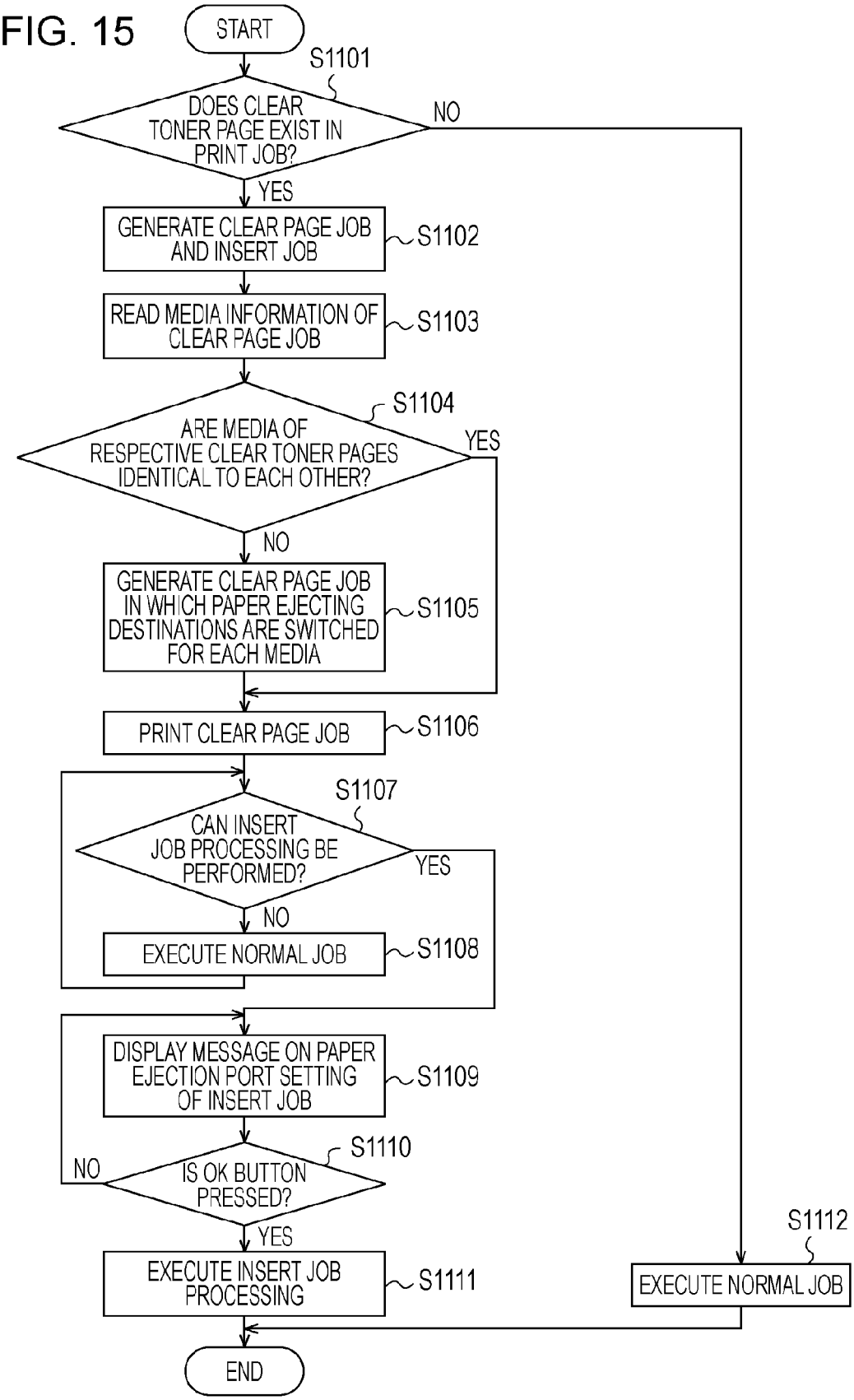
FIG. 15 is a flow chart for describing an example of a processing operation performed by a print server according to a third exemplary embodiment of the present invention.

FIG. 15 is a flow chart for describing an example of a processing operation in the print server 101.

First, in step S1101, the job analysis unit 607 reads the print instruction information obtained from the print job which is transmitted from the client computer 102 to determine whether the setting related to the clear toner page exists in the print instruction information.

As a result of this determination, in a case where the setting related to the clear toner page does not exist in the print instruction information (NO in step S1101), the processing flow advances to step S1112, where the processing of the print job functioning as a normal print job is executed, and processing may be ended.

On the other hand, in a case where the setting related to the clear toner page exists in the print instruction information (YES in step S1101), the flow advances to step S1102. When the flow advances to step S1102, the job analysis unit 607 generates two jobs including the clear page job and the insert job.

Next, in step S1103, the job queue 608 reads all the media information on the clear toner page (the sheet size and the sheet time information) from the print instruction information the clear page job generated in step S1102.

Next, in step 1104, on the basis of the media information read in step S1103, the job queue 608 determines whether the attribute of the media is the same in the respective clear toner pages (for example, the sheet size and the sheet type information). As a result of this determination, in a case where the media is the same in the respective clear toner pages (YES in step S1104), the processing flow skips step S1105 and advances to step S1106.

On the other hand, in a case where the media is not the same in the respective clear toner pages (NO in step S1104), the processing flow advances to step S1105. When the flow advances to step S1105, the job queue 608 sets different information of the paper ejecting destinations included in the print instruction information of the respective clear page jobs for each media. It is noted that depending on the number of media having different information of the paper ejecting destinations, the paper ejecting destinations of the network printer may run short. In this case, instead of changing the information of the paper ejecting destinations, shift paper ejection information may be added to the print instruction information. With this configuration, at the same paper ejecting destination, it is possible to change the paper ejecting directions for each media, and even in a case where the paper ejecting destinations of the network printer runs short, it may be possible to easily sort out the media.

In addition, in the present step, the job queue 608 also sets the sheet feeding port of the clear toner page in the insert job. It is noted that in a case where the number of media in the clear toner page exceeds the sheet feeding ports of the network printer, for the exceeding part, the job queue 608 sets "manual insertion" as the information on the sheet feeding port.

As described above, according to the present embodiment, for example, by performing the processing in step S1102 to S1105, an example of the generation unit may be realized.

Next, in step S1106, the job queue 608 instructs the data information transmission and reception unit 609 to transmit the clear page job to the network printer specified by the user (for example, the network printer 105). With this configuration, the clear page job is executed, and the print using the colored toner is performed. While following the information on the paper ejection port set in step S1105 or the shift paper ejection information, the respective clear toner pages are ejected so that the paper ejection ports and the paper ejecting directions are different. In the above-described manner, according to the present embodiment, for example, by performing the processing in step S1106, an example of the first instruction unit may be realized.

Next, in step S1107, as the job queue 608 determines whether the job resting period of time from the clear page job printed in step S1106 has elapsed, it is determined whether the processing on the insert job can be performed. As a result of this determination, in a case where the job resting time has elapsed and the insert job can be performed (YES in step S1107), the processing flow advances to step S1109, and in a case where the job resting time has not elapsed and the insert job cannot be performed (NO in step S1107), the processing flow advances to step S1108.

When the processing flow advances to step S1108, the job queue 608 instructs the data information transmission and reception unit 609 to perform the transmission of the print job which is the print job other than the clear page job and the insert job among the print jobs in the print queue and which is located at the forefront. When the processing is performed on one print job in step S1108, the processing flow is returned to step S1107. With this configuration, the normal print job piled up in the spooler may be executed one by one.

In the above-described manner, according to the present embodiment, for example, by performing the processing in step S1108, an example of the third instruction unit is realized.

On the other hand, when the processing flow advances to step S1109, the display unit 611 displays the insert job processing execution message (GUI) and notifies the sheet feeding port information related to the sheet feeding port for feeding the sheet, and also urges the user to press the print execution button. In the present step, the sheet feeding port information may be displayed for each page for the clear page job and media.

In the above-described manner, according to the present embodiment, for example, by performing the processing in step S1109, an example of the notification unit may be realized.

Next, in step S1110, the job queue 608 determines whether the user presses the print execution button included in "the insert job processing execution message (GUI)" displayed in step S1109. As a result of this determination, in a case where the print execution button is not pressed (NO in step S1110), the processing flow is returned to step S1109. On the other hand, in a case where the print execution button is pressed (YES in step S1110), the processing flow advances to step S1111.

When the processing flow advances to step S1111, the job queue 608 instructs the data information transmission and reception unit 609 to transmit the insert job. With this configuration, regarding the clear toner page, while following the insert job generated in step S702, the sheet is fed from the sheet feeding port specified in step S1109. After only the clear toner is printed, the sheet is inserted into the specified page and then ejected. On the other hand, regarding the other pages, while following the insert job generated in step S1102, the content is printed, and the sheet is ejected. It is noted that in a case where the sheet feeding port is "manual feed", the display unit 611 displays a message for allowing the user to specify the sheet feeding port information each time.

In the above-described manner, according to the present embodiment, for example, by performing the processing in step S1111, an example of the second instruction unit may be realized. Processing may then be ended.

As described above, according to the present embodiment, in a case where the attributes of the media in the pages constituting the clear page job (the size of the sheet, the type, and the like) are different depending on the pages, the page on which the print using the colored toner has been performed is ejected so as to be distinguished for each media attribute. Therefore, when the insert job is executed, it is possible to increase the operation efficiency for setting the sheet on which the print using the colored toner has been performed to the sheet feeding port.

It is noted that according to the present embodiment too, similarly to the first exemplary embodiment, for example, between steps S1105 and S1106 of FIG. 15, the processing in steps S703 and S704 of FIG. 7 may be performed.

In addition, the present embodiment can also be applied to the second exemplary embodiment. For example, between steps S803 and S812 of FIG. 11, the processing in steps S1103 to S1105 of FIG. 15 may be performed.

Next, a fourth exemplary embodiment of the present invention will be described. According to the above-described first exemplary embodiment, during the job resting time, the normal job at the forefront of the spooler is executed. In contrast, according to the present embodiment, the normal job which can be processed during the job resting time is configured to be executed in priority. In this way, by comparing the present embodiment with the above-described first exemplary embodiment, a part of the processing is different when the print job is performed. Thus, in the description of the present embodiment, similar configurations to those of the above-described first exemplary embodiment are denoted by the same reference given to FIGS. 1 to 10, for example, and a detailed description thereof will be omitted.

Figure 16:
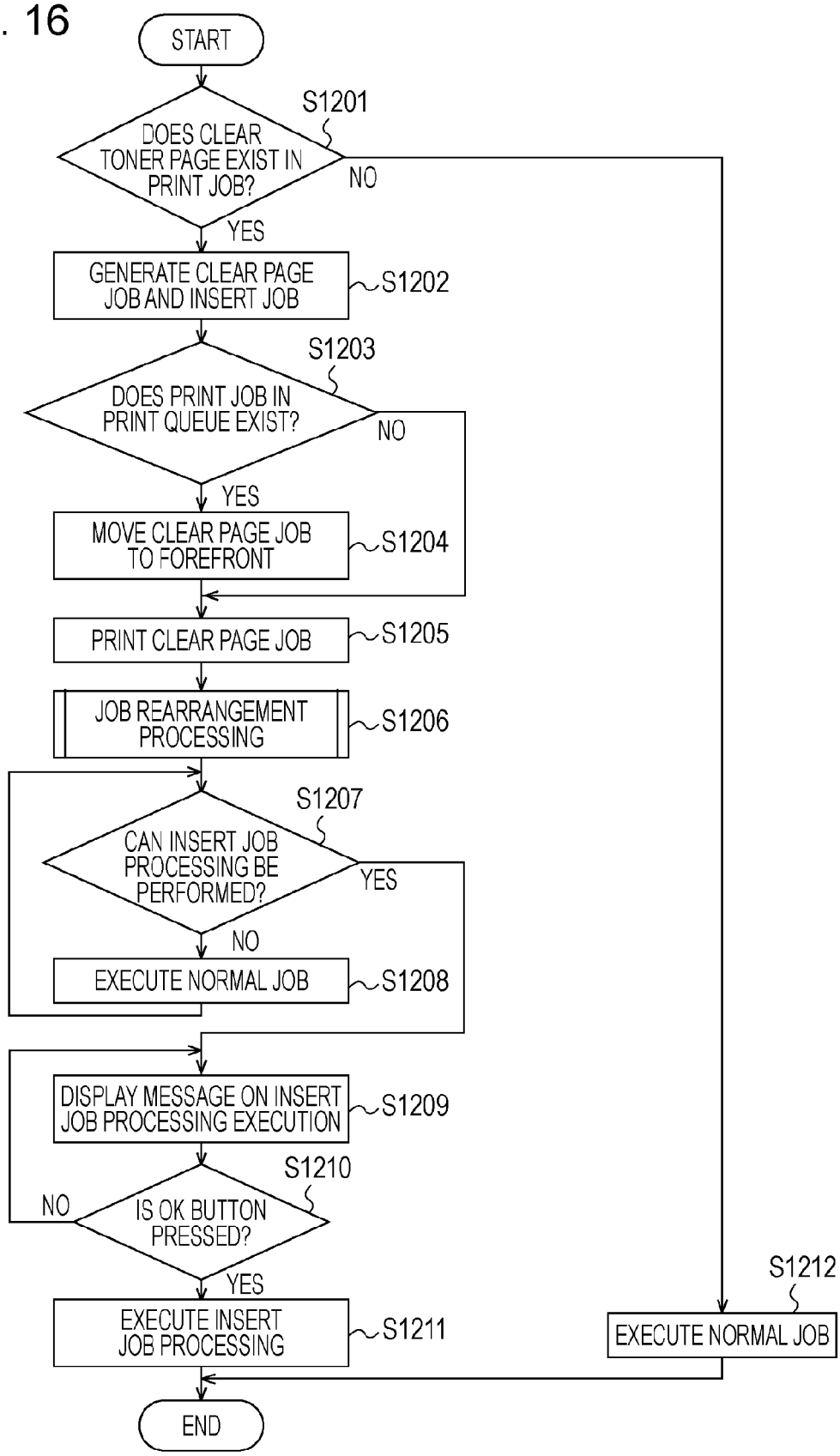
FIG. 16 is a flow chart for describing an example of a processing operation performed by a print server according to a fourth exemplary embodiment of the present invention.

FIG. 16 is a flow chart for describing an example of a processing operation in the print server 101.

First, in step S1201, the job analysis unit 607 reads the print instruction information obtained from the print job which is transmitted from the client computer 102 to determine whether the setting related to the clear toner page exists in the print instruction information.

As a result of this determination, in a case where the setting related to the clear toner page does not exist in the print instruction information (NO in step S1201), the processing flow advances to step S1212, the processing of the print job functioning as a normal print job is executed, after which processing may be ended.

On the other hand, in a case where the setting related to the clear toner page exists in the print instruction information (YES in step S1201), the processing flow advances to step S1202. When the processing flow advances to step S1202, the job analysis unit 607 generates two jobs including the clear page job and the insert job.

In the above-described manner, according to the present embodiment, for example, by performing the processing in step S1202, an example of the generation unit may be realized.

Next, in step S1203, the job analysis unit 607 determines whether the print stand-by print job exists in the job queue 608. As a result of this determination, in a case where the print job in the print queue does not exist (NO in step S1203), the processing flow skips step S1204 and advances to step S1205.

On the other hand, in a case where the print job in the print queue exists (YES in step S1203), the processing flow advances to step S1204, and the job queue 608 moves the clear page job generated in step S1202 to a position before the forefront of the print job in the print queue. It is noted that in a case where the clear page job is already in the print queue, the job queue 608 registers the clear page job generated in step S1202 at the end of the print page job in the print queue.

Next, in step S1205, the job queue 608 instructs the data information transmission and reception unit 609 to transmit the clear page job to the network printer specified by the user (for example, the network printer 105). With this configuration, the clear page job is executed, and the print based on the colored toner is performed.

As described above, according to the present embodiment, for example, by performing the processing in steps S1204 and S1205, an example of the first instruction unit may be realized.

Next, in step S1206, the job rearrangement processing is executed.

Figure 17:
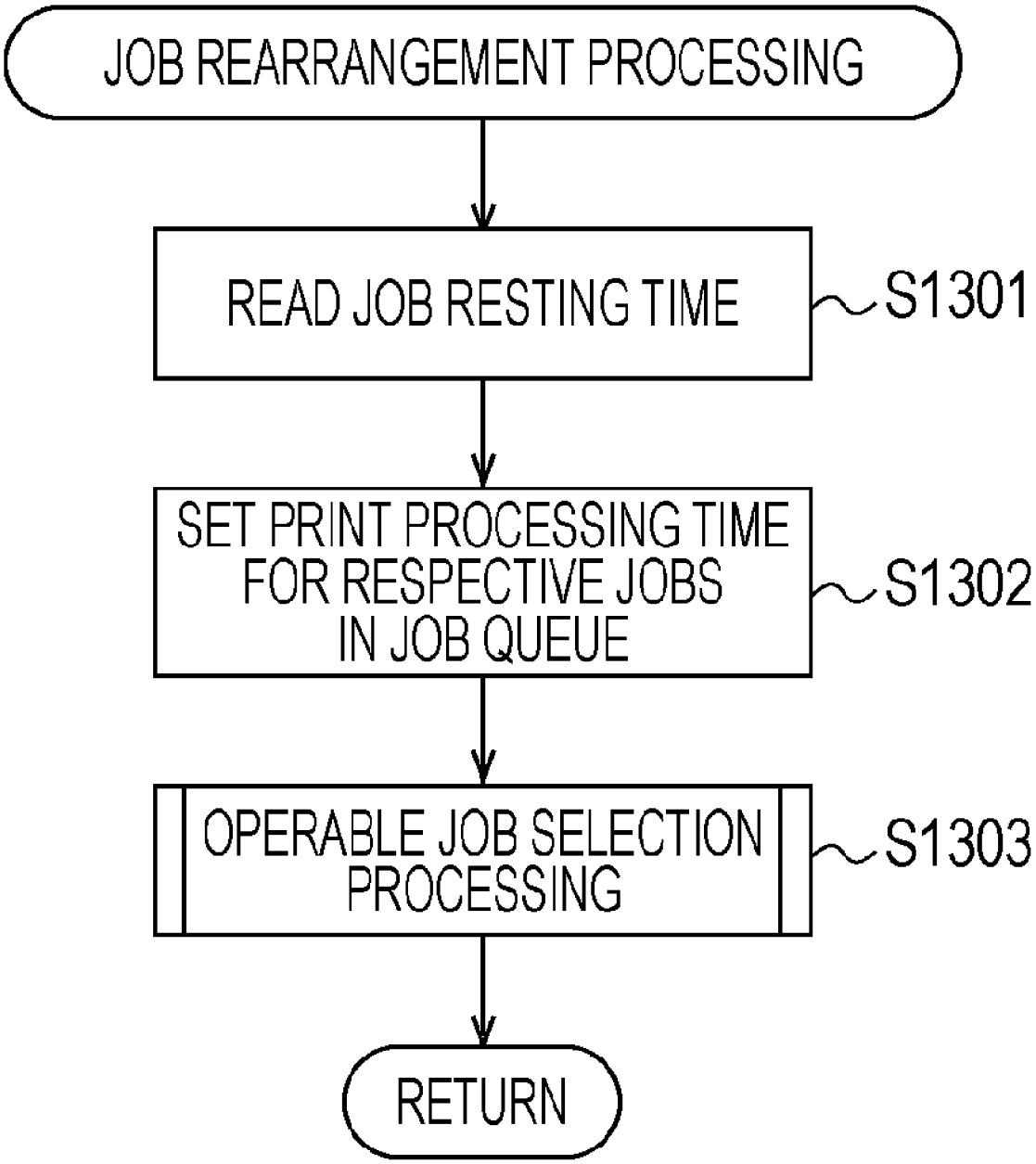
FIG. 17 is a flow chart for describing a detailed example of a job rearrangement processing in step S1206 according to the fourth exemplary embodiment of the present invention.

FIG. 17 is a flow chart for describing an example of the job rearrangement processing in step S1206 in detail.

In the job rearrangement processing, first, in step S1301, the job queue 608 reads the job resting time of the clear page job.

Next, in step S1302, the job queue 608 calculates a print processing expectation time in the respective jobs in the job queue 608. As a method of calculating the job processing time, a method of calculating the job processing time on the basis of the number of pages in the job is proposed.

Next, in step S1303, during the job resting time, the job queue 608 executes an operable job selection processing for registering the executable job.

Figure 18:
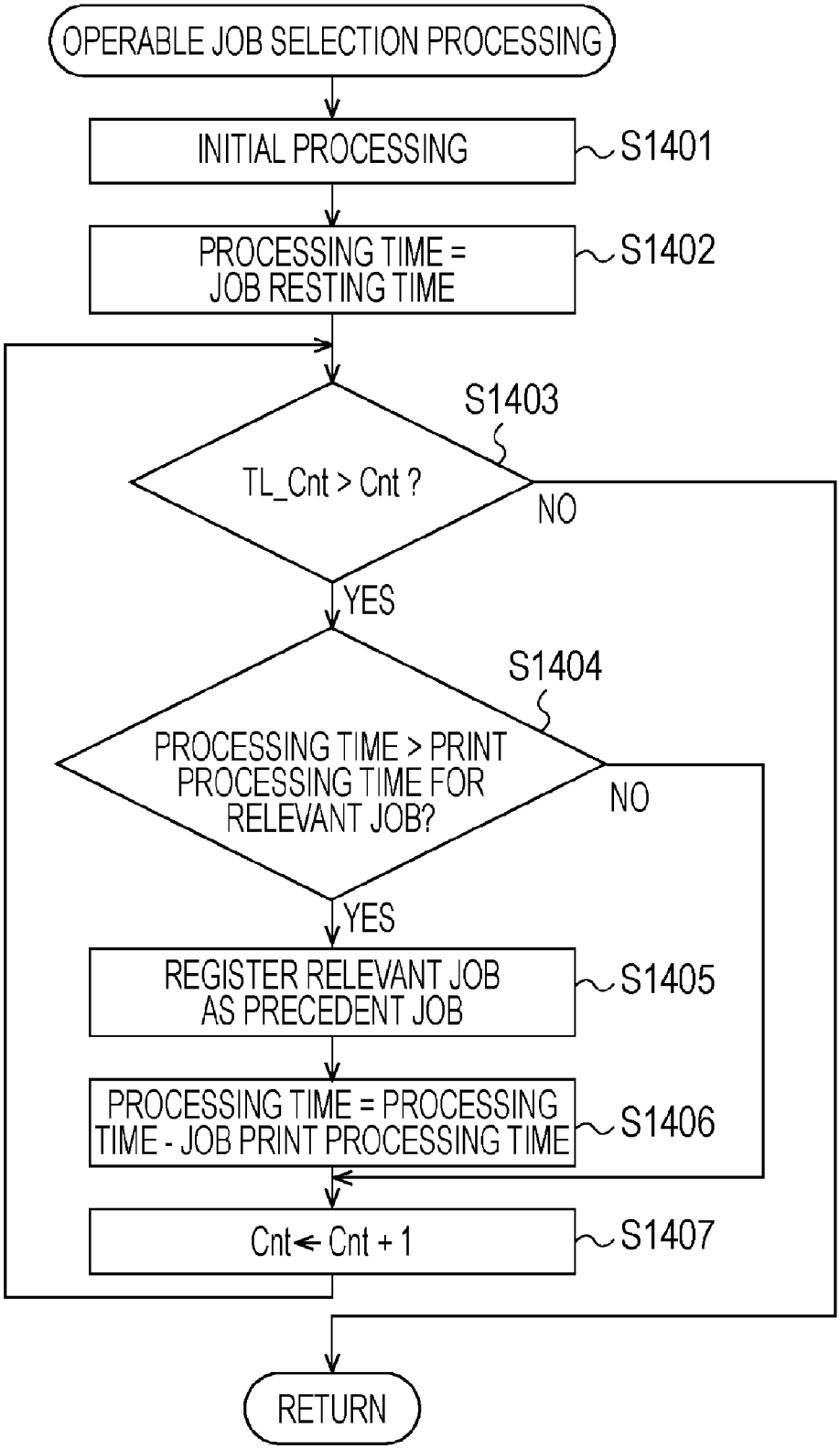
FIG. 18 is a flow chart for describing a detailed example of an operable job selection processing in step S1803 according to the fourth exemplary embodiment of the present invention.

FIG. 18 is a flow chart for describing an example of the operable job selection processing in step S1303 in detail.

In the operable job selection processing, first, in step S1401, the job queue 608 reads the number of jobs in the job queue 608 to be set as the variable TL_Cnt, and also initializes the value of the counter Cnt to 0. Also, the job queue 608 registers an empty job for inputting the insert job in the job queue 608 as a separator job.

Next, in step S1402, the job queue 608 sets the job resting time as a variable "processing time".

Next, in step S1403, the job queue 608 determines whether the value of the read out variable TL_Cnt is larger than the value of the counter Cnt to determine whether reading of all the jobs in the job queue 608 is completed. As a result of this determination, in a case where the value of the read out variable TL_Cnt is equal to or smaller than the value of the counter Cnt and reading of all the jobs in the job queue 608 is completed (NO in step S1403), the processing flow advances to step S1207 of FIG. 16.

On the other hand, in a case where the value of the read out variable TL_Cnt is larger than the value of the counter Cnt and reading of all the jobs in the job queue 608 is not completed (YES in step S1403), the processing flow advances to step S1404. When the processing flow advances to step S1404, the job queue 608 determines whether the print processing time for the relevant job (job identified by the value of the counter Cnt) is smaller than the current value of the variable "processing time".

As a result of this determination, in a case where the print processing time for the relevant job is equal to or larger than the current value of the variable "processing time" (NO in step S1404, the processing flow skips S1405 and S1406 and advances to step S1407. On the other hand, in a case where the print processing time for the relevant job is smaller than the current value of the variable "processing time" (YES in step S1404), the processing flow advances to step S1405.

It is noted that herein, it is determined as to whether the print processing time for the relevant job is smaller than the current value of the variable "processing time", but it may also be determined as to whether the print processing time for the relevant job is equal to or smaller than the current value of the variable "processing time". With this configuration, also even in a case where the processing time is equal to the print processing time for the job, it is possible to register the job in which the processing is performed in priority.

When the flow advances to step S1405, the job queue 608 registers the relevant job as a job in which the processing is performed in priority.

Next, in step S1406, the job queue 608 subtracts the print processing time for the job registered in step S1405 from the variable "processing time" to update the value of the variable "processing time".

Next, in step S1407, the job queue 608 increments the value of the counter Cnt. Then, the processing flow returns to step S1403.

While returning to the description on FIG. 16, in step S1207, as the job queue 608 determines whether the clear page job printed in step S1205 elapses the job resting period of time, it is determined whether the processing on the insert job can be performed. As a result of this determination, in a case where the job resting time has elapsed or the read job is the separator job (YES in step S1207, optionally, the processing may stand by until the open time for the insert job arrives, and the processing flow advances to step S1209.

On the other hand, and in a case where the job resting time has not elapsed and the insert job cannot be performed (NO in step S1207), the processing flow advances to step S1208. When the processing flow advances to step S1208, the job queue 608 instructs the data information transmission and reception unit 609 to perform the transmission of the print job which is the print job other than the clear page job and the insert job among the print jobs in the print queue and which is located at the forefront. When the processing is performed on one print job, the processing flow returns to step S1207. With this configuration, the normal print job piled up in the spooler may be executed one by one. In this step S1208, the normal print job registered in step S1206 may be executed.

As described above, according to the present embodiment, for example, by performing the processing in steps S1206 to S1208, an example of the third instruction unit may be realized.

When the flow advances to step S1209, the display unit 611 displays the insert job processing execution message (GUI), and urges the user to perform the specification of the sheet feeding port to which the printed product is set and press the print execution button.

In the above-described manner, according to the present embodiment, for example, by performing the processing in step S1209, an example of the notification unit may be realized.

Next, in step S1210, the job queue 608 determines whether the user presses the print execution button included in "the insert job processing execution message (GUI)" displayed in step S1209. As a result of this determination, in a case where the print execution button is not pressed (NO in step S1210), the processing flow returns to step S1209. On the other hand, in a case where the print execution button is pressed (YES in step S1210), the processing flow advances to step S1211.

When the flow advances to step S1211, the job queue 608 instructs the data information transmission and reception unit 609 to transmit the insert job. With this configuration, regarding the clear toner page, while following the insert job generated in step S702, the sheet is fed from the sheet feeding port specified in step S1209. After only the clear toner is printed, the sheet is inserted into the specified page and then ejected. On the other hand, regarding the other pages, while following the insert job generated in step S1202, the content is printed, and the sheet is ejected.

In the above-described manner, according to the present embodiment, for example, by performing the processing in step S1211, an example of the second instruction unit may be realized.

As described above, according to the present embodiment, the normal job in which the processing can be ended by the time when the job resting time has elapsed is registered, and the registered normal job may be processed during the job resting time. Therefore, it may be possible to efficiently perform the execution of the normal job in the job resting time.

It is noted that with the value of the counter Cnt, if the processing in step S1404 is performed from the job whose print processing time is relatively short, it may be possible to process more jobs during the job resting time, which may be preferable.

In addition, the present embodiment can also be applied to the second exemplary embodiment. For example, between steps S806 and S807 of FIG. 11, the processing in step S1206 of FIG. 16 may be performed.

In addition, the present embodiment can also be applied to the third exemplary embodiment. For example, between steps S1202 and S1203, the processing in steps S1104 and S1105 may be performed.

Next, a fifth exemplary embodiment of the present invention will be described. According to the above-described first to fourth exemplary embodiments, only the clear toner page is set as a target of the clear page job. However, in a case where both the clear page job and the insert job have color pages, color shades may be changed due to a difference in print timings. In view of the above, according to the present embodiment, in a case where the clear toner page is color, color pages other than the clear toner page are also set as the targets of the clear page job. In this way, as the present embodiment is compared with the above-described first to fourth exemplary embodiments, a part of the processing is different when the print job is performed. Thus, in the description of the present embodiment, similar configurations to those of the above-described first to fourth exemplary embodiments are assigned with the same reference numerals given to FIGS. 1 to 18, and a detailed description thereof will be omitted.

Figure 19:
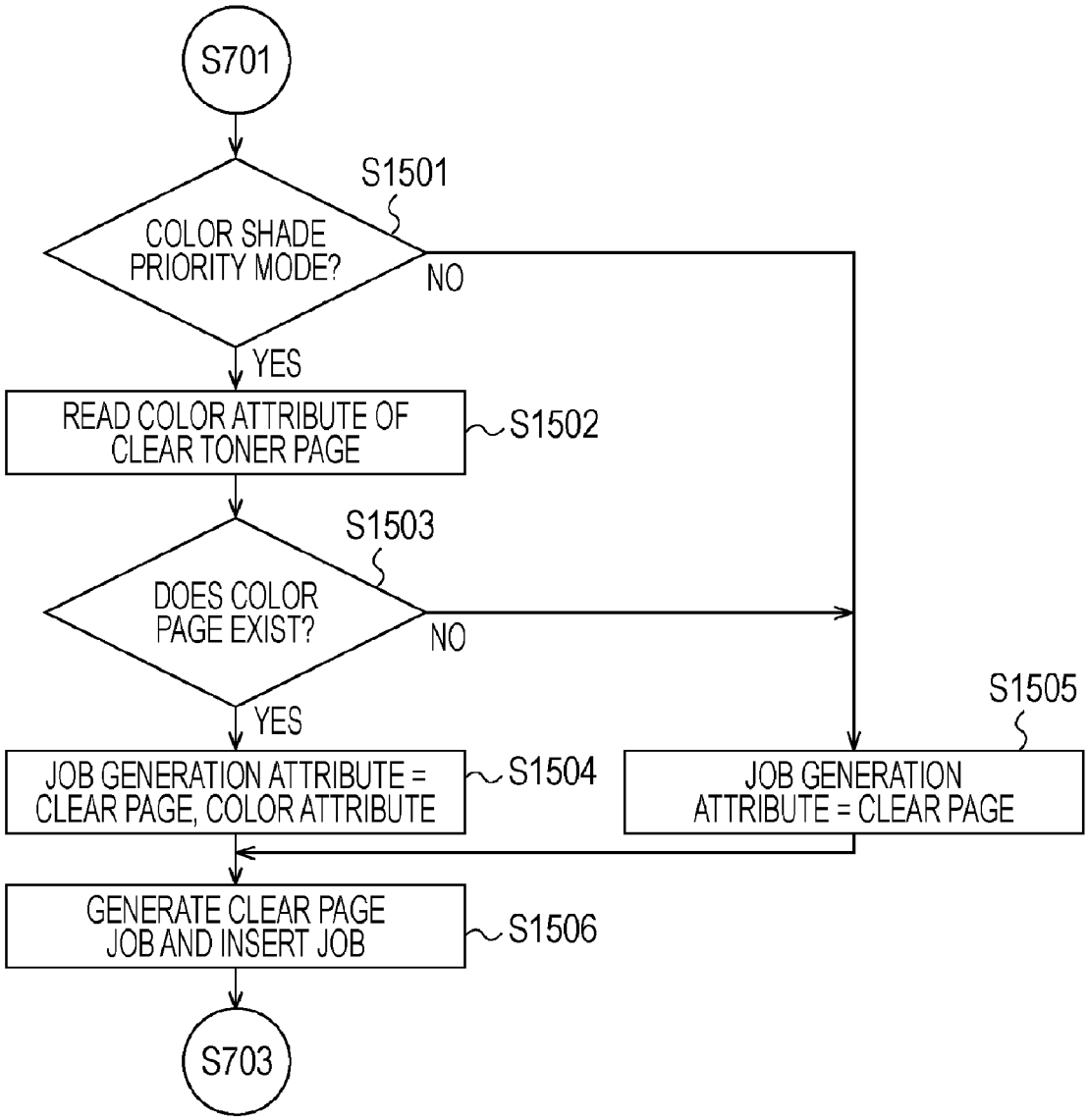
FIG. 19 is a flow chart for describing an example of a processing operation performed by a print server when a clear page job and an insert job are generated from a print job according to a fifth exemplary embodiment of the present invention.

The present embodiment can be executed by replacing step S702 of FIG. 7 with a flow chart shown in FIG. 19 and performing the processing. FIG. 19 is a flow chart for describing an example of a processing operation in the print server 101 when the clear page job and the insert job are generated from the print job.

First, in step S1501, the job analysis unit 607 determines whether a color shade priority mode is set. Herein, the color shade priority mode refers to a mode of matching the color shades of the jobs, in which print timings for all the color pages in one print job are matched with each other. That is, all the color pages in the print job are included in the clear page job. This setting of the color shade priority mode can be performed, for example, on the basis of the user operation on the GUI displayed on the client computer 102 or the print server 101.

As a result of this determination, in a case where the color shade priority mode is not set (NO in step S1501), the processing flow advances to step S1505 which will be described below. On the other hand, in a case where the color shade priority mode is set (YES in step S1501), the processing flow advances to step S1502. When the processing flow advances to step S1502, the job analysis unit 607 reads the color attribute of the clear toner page.

Next, in step S1503, the job analysis unit 607 determines in step S1502 whether the color attribute is read to determine whether a color page exists in the clear toner page.

In the above-described manner, according to the present embodiment, for example, by performing the processing in step S1503, an example of the determination unit may be realized.

As a result of this determination, in a case where a color page exists (YES in step S1503), the processing flow advances to step S1504. When the processing flow advances to step S1504, the job analysis unit 607 sets the clear toner page and other color pages as generation conditions for the clear page job (e.g., the job generation attribute). Processing then advances to step S1506.

On the other hand, in a case where a color page does not exist (NO in step S1503), the processing flow advances to step S1505. When the flow advances to step S1505, the job analysis unit 607 sets the clear toner page as the generation conditions for the clear page job (e.g., the job generation attribute). Processing then advances to step S1506.

Then, in step S1506, the job analysis unit 607 generates two jobs including the clear page job and the insert job. The clear page job generated at this time is generated on the basis of the generation conditions for the clear page job set in steps S1504 and S1505. In a case where the generation conditions for the clear page job are set as the clear toner page and other color pages, the job analysis unit 607 generates a clear toner job including "the clear toner page and the page having the attribute of the color page" in the print job. Also, in this case, the job analysis unit 607 generates the insert job including the page having the attribute except for the color page among pages other than the clear toner page. Processing may then advance to step S703.

Figure 20:
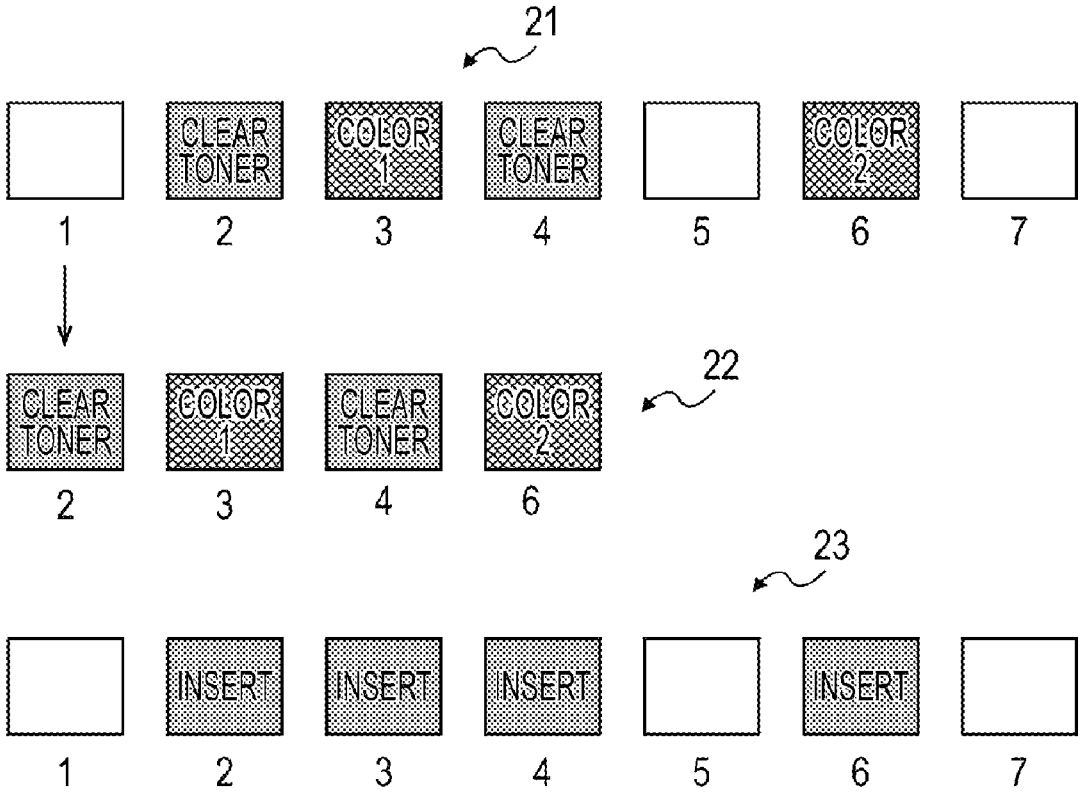
FIG. 20 is a conception diagram of an example of a job structure to be generated according to the fifth exemplary embodiment of the present invention.

FIG. 20 is a conception diagram of an example of a job structure to be generated.

As illustrated in FIG. 20, it is supposed that the pages 2 and 4 of the input print job 21 have the instruction of the clear toner page, and the pages 3 and 6 have the instruction of the color attribute. In this case, the job analysis unit 607 generates a job for only printing the pages 2, 3, 4, and 6 as a clear job 22. Herein, the clear job 22 can be generated by specifying the print page range in the print instruction information. Also, it is possible to generate a print job composed of only the relevant pages (the pages 2 to 4 and 6 in the above-described example) as the clear job 22.

On the other hand, when the insert job 23 is executed, the pages 2, 3, 4, and 6 corresponding to the clear toner pages are fed from a desired sheet feeding port of the network printer 105. After that, regarding the fed sheet, without printing the content, only the clear toner is used, and the print for the second time is performed. At this time, the print of the remaining pages other than the clear toner pages is also carried out. Then, the sheet on which the print for the second time is performed by only using the clear toner is inserted into the pages 2, 3, 4, and 6 of the print job 21, and the respective pages of the print job 21 are ejected. Herein, the insert job 23 can be generated, for example, by specifying "no content print" and "clear toner print" with respect to the print attribute of the relevant page.

As described above, according to the present embodiment, for example, by performing the processing in steps S1504 and S1505, an example of the generation unit may be realized.

As described above, according to the present embodiment, in a case where the color page exists in the clear toner page, among the pages other than the clear toner page, the page including the color is printed together with the clear toner page as the clear page job. With this configuration, the clear toner print can be performed with the uniform color shades.

Next, a sixth exemplary embodiment of the present invention will be described. According to the above-described first to fifth exemplary embodiments, the case in which the clear toner page is manually set by the user has been described as an example. In contrast, according to the present embodiment, in accordance with the print method, the clear toner page is automatically set. In this way, as the present embodiment is compared with the above-described first to fifth exemplary embodiments, a part of the processing is different when the print job is performed. Thus, in the description of the present embodiment, similar configurations to those of the above-described first to fifth exemplary embodiments are assigned with the same reference numerals given to FIGS. 1 to 20, for example, and a detailed description thereof will be omitted.

Figure 21:
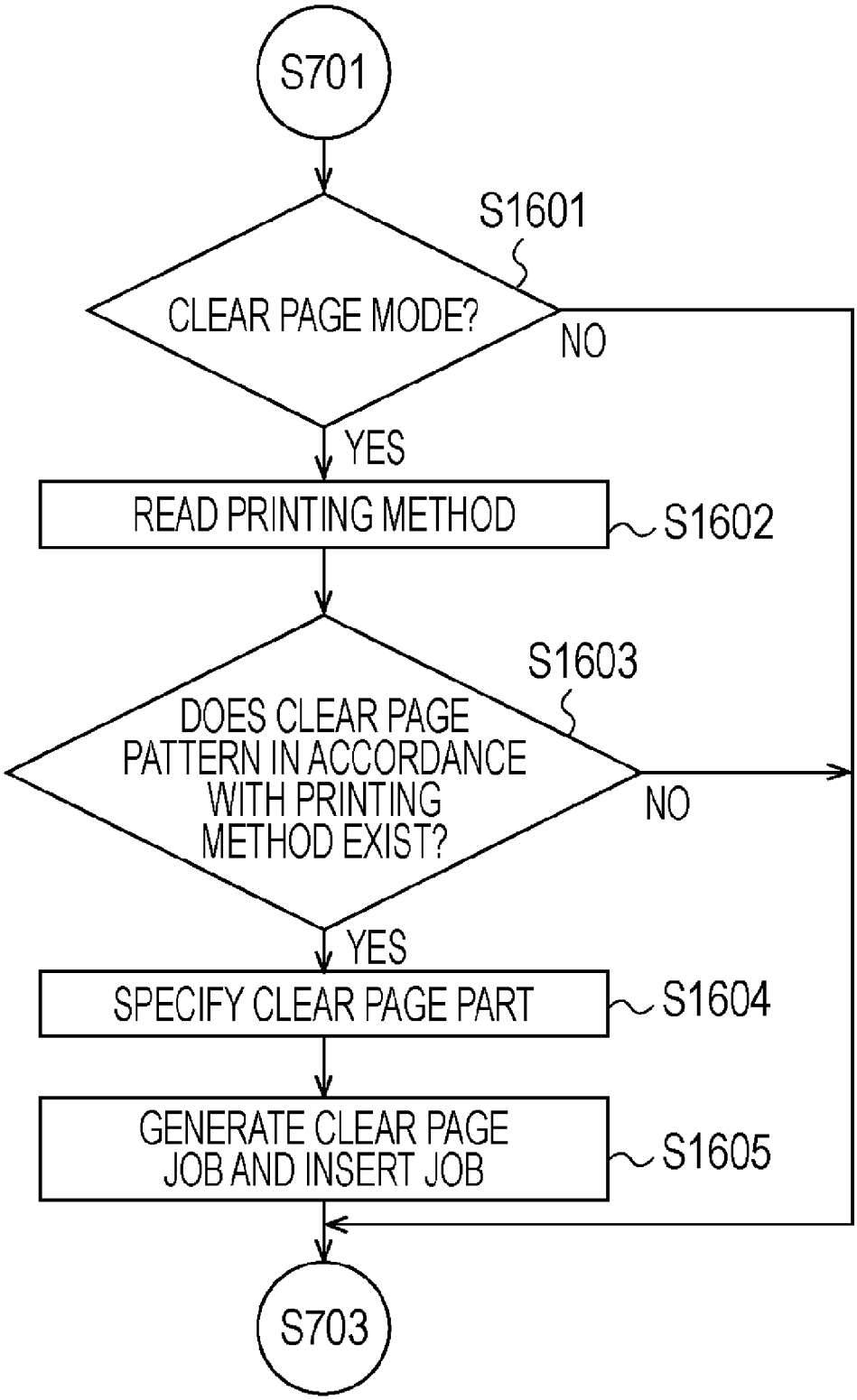
FIG. 21 is a flow chart for describing an example of a processing operation performed by a print server when a clear page job and an insert job are generated from a print job according to a sixth exemplary embodiment of the present invention.

The present embodiment can be executed by performing a processing while step S702 of FIG. 7 is replaced by a flow chart shown in FIG. 21. FIG. 21 is the flow chart for describing an example of a processing operation in the print server 101 when the clear page job and the insert job are generated from the print job.

First, in step S1601, the job analysis unit 607 determines whether a clear page mode is set. Herein, the clear page mode refers to a mode of automatically setting a page on which the clear toner is borne (e.g., developed and fixed) (i.e., the clear toner page) in accordance with the print method. This setting for the clear page mode can be performed, for example, on the basis of the user operation on the GUI displayed on the client computer 102 or the print server 101.

As a result of this determination, in a case where the clear page mode is not set (NO in step S1601), the processing flow advances to step S703 of FIG. 7. On the other hand, in a case where the clear page mode is set (YES in step S1601), the processing flow advances to step S1602. When the flow advances to step S1602, the job analysis unit 607 reads the print method. For example, the print method such as the bookbinding printing may be read from the print job.

Next, in step S1603, the job analysis unit 607 determines whether a clear toner page setting pattern in accordance with the print method read in step S1502 exists in the print job.

Herein, the clear toner page setting pattern refers to information generated by specifying a page as the clear toner page in accordance with the print method. As a specific example, in the case of the bookbinding printing, information in which pages corresponding to cover pages (in the example shown in FIG. 14, pages P1, P2, P11, and P12) are set as the clear toner page may be included in the clear toner page setting pattern. It is noted that as this clear toner page setting pattern, a pattern previously registered in the system may be used, or a user may register a pattern in accordance with the print setting.

As a result of the determination in step S1603, in a case where the clear page setting pattern does not exist (NO in step S1603), the processing flow advances to step S703 of FIG. 7. On the other hand, in a case where the clear page setting pattern exists (YES in step S1602), the flow advances to step S1604.

When the flow advances to step S1604, the job analysis unit 607 performs the setting of the clear toner page on the print instruction information included in the print job on the basis of the clear page setting pattern determined in step S1603.

In the above-described manner, according to the present embodiment, for example, by performing the processing in step S1604, an example of an identification unit may be realized.

Next, in step S1605, the job analysis unit 607 generates the two jobs including the clear page job and the insert job. The clear page job generated at this time includes the clear toner page set in step S1604.

In the above-described manner, according to the present embodiment, for example, by performing the processing in step S1605, an example of the generation unit may be realized.

As described above, according to the present embodiment, in accordance with the print method, as the page functioning as the clear toner page is automatically set from the respective pages of the print job, it is possible to eliminate the labor for the user to set the clear toner page. Therefore, it may be possible to further reduce the operational burden of the user in the print operation.

The respective units constituting the print management apparatus and the respective steps of the print management method according to the above-described embodiments of the present invention can be realized while a program stored in a RAM, a ROM, or the like of a computer is operated, and/or while computer-executable instructions in said RAM, ROM or the like of a computer are executed. Aspects of the present invention thus include a computer-readable recording medium on which this program and/or computer-executable instructions are recorded.

In addition, aspects of the present invention can be realized, for example, by way of embodiments as a system, an apparatus, a method, a program and/or computer-executable instructions, a storage medium, and the like. To be more specific, the present invention may be applied to a system comprising a plurality of devices and also be applied to an apparatus comprising a single device.

It is noted that aspects of the present invention also include an embodiment in which a software program and/or computer-executable instructions for realizing the functions of the above-described embodiments (e.g., the programs corresponding to the flow charts shown in FIGS. 7, 11 to 13, 15 to 19, and 21 according to the embodiments) is directly or remotely supplied to the system or the apparatus. Then, a computer of the system or the apparatus reads and executes the supplied program code and/or computer-executable instructions to realize functions according to the above-described embodiments.

Therefore, in order to realize functional processing by the computer, the program code and/or computer-executable instructions installed into the computer may realize aspects according to the present invention. That is, aspects of the present invention may also include the computer-readable recording medium having stored thereon the program code and/or computer-executable instructions for realizing functional processing according to aspects of present invention.

In that case, as long as the function of the program and/or computer-executable instructions is provided, modes such as any one of an object code, a program executed by an interpreter, and a script data supplied to an OS may be employed.

As the storage medium and/or recording medium for supplying the program and/or computer-executable instructions, for example, for example, one or more of a flexible disk, a hard disk, an optical disk, an opto-magnetic disk, an MO, a CD-ROM, a CD-R, a CD-RW, and the like can be used. Also, one or more of a magnet tape, a non-volatile memory card, a ROM, a DVD (DVD-ROM, DVD-R), and the like can also be used.

In addition to the above, as a method of supplying the program and/or computer-executable instructions, a connection may be established to a home page of the internet by using a browser of the client computer. Then, the program and/or computer-executable instructions can be supplied in such a manner that the computer program and/or computer-executable instructions according to the present invention or a compressed file containing an automatic install function may be downloaded from the home page into a recording medium such as hard disk.

In addition, aspects of the present invention can be realized while the computer program and/or computer-executable instructions according to embodiments of the present invention is divided into a plurality of files, and the respective files are downloaded from different home pages. That is, the present invention also includes a WWW server configured to allow a plurality of users to download the computer files for realizing functional processing according to aspects of the present invention in the computer.

In addition, aspects of the present invention can be realized in the following manner. The program and/or computer-executable instructions according to embodiments of the present invention may be encrypted to be stored in a storage medium such as a CD-ROM and distributed to a user, and a user who satisfies a predetermined condition can download key information for decrypting the encryption from a home page via the internet. Then, by using the downloaded key information, the encrypted program and/or computer-executable instructions may be executed and installed into the computer.

In addition, as the computer executes the read program and/or computer-executable instructions, the functions according to the above-described embodiments may be realized. In addition, aspects of the present invention may include a case where a part or all of the actual process is performed by an OS (e.g., a basic system or an operation system) or the like which is running on the computer on the basis of an instruction of the program and/or computer-executable instructions, and the functions according to the above-described embodiments may also be realized through the processing.

Furthermore, the program code and/or computer executable instructions read out from the recording medium may be written in a memory that is provided to a function expansion board inserted in the computer or a function expansion unit connected to the computer. After that, on the basis of the instruction of the program and/or computer-executable instructions, a CPU or the like provided to the function expansion board or the function expansion unit may perform a part or all of the actual process, and functions according to the above-described embodiments may also be realized through the processing.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-095507 filed Apr. 1, 2008, which is hereby incorporated by reference herein in its entirety.

What is claimed is:

1. A print management apparatus comprising:

a generation unit configured to generate, from a document including a clear toner page on which both colored toner and clear toner are used and an insert page on which the colored toner is used without the use of the clear toner, a clear toner page print job for printing the clear toner page by using the colored toner without using the clear toner, and generate an insert print job for applying the clear toner on the clear toner page printed by using the colored toner without using the clear toner and for printing the insert page by using the colored toner;

a first instruction unit configured to instruct an execution of the clear toner page print job generated by the generation unit; and a second instruction unit configured to instruct an execution of the insert print job generated by the generation unit after a predetermined period of time elapses.

2. The print management apparatus according to claim 1, further comprising:

a storage unit configured to store the clear toner page print job and the insert print job generated by the generation unit while associating the print jobs to each other; and a third instruction unit configured to instruct an execution of a print job different from the insert print job associated with the clear toner page print job until the predetermined period of time elapses since the execution of the clear toner page print job is instructed by the first instruction unit.

3. The print management apparatus according to claim 2, wherein the third instruction unit instructs an execution of a print job which ends by a time when the predetermined period of time elapses.

4. The print management apparatus according to claim 1, further comprising:

a determination unit configured to determine whether at least one of the clear toner pages is a color page, wherein the generation unit generates, in a case where the determination unit determines that at least one of the clear toner pages is a color page, a clear toner page print job for printing the clear toner page and the color page among the insert pages by using the colored toner.

5. The print management apparatus according to claim 1, further comprising:

a second determination unit configured to determine whether a stand-by print job exists in a case where the generation unit generates the clear toner page print job, wherein in a case where the second determination unit determines that the stand-by print job exists, the first instruction unit instructs the execution of the clear toner page print job in priority to the stand-by print job.

6. The print management apparatus according to claim 1, further comprising:

a notification unit configured to notify of a message for urging the execution of the insert print job after a time based on the predetermined period of time elapses.

7. A print management apparatus comprising:

an identification unit configured to identify, from a document including a clear toner page on which both colored toner and clear toner are used and an insert page on which the colored toner is used without the use of the clear toner, the clear toner page; and a first instruction unit configured to instruct printing of the clear toner page identified by the identification unit by using the colored toner without the clear toner; and a second instruction unit configured to instruct printing of the insert print job after the instruction performed by the first instruction unit.

8. A print management method comprising:

generating, from a document including a clear toner page on which both colored toner and clear toner are used and an insert page on which the colored toner is used without the use of the clear toner, a clear toner page print job for printing the clear toner page by using the colored toner without using the clear toner, and generating an insert print job for applying the clear toner on the clear toner page printed by using the colored toner without using the clear toner and for printing the insert page by using the colored toner;

instructing an execution of the generated clear toner page print job; and instructing an execution of the generated insert print job after a predetermined period of time elapses.

9. The print management method according to claim 8, further comprising:

storing the generated clear toner page print job and the generated insert print job while associating the print jobs to each other; and instructing an execution of a print job different from the insert print job associated with the clear toner page print job until the predetermined period of time elapses since the execution of the clear toner page print job is instructed.

10. The print management method according to claim 9, comprising instructing an execution of a print job which ends by a time when the predetermined period of time elapses.

11. The print management method according to claim 8, further comprising:

determining whether at least one of the clear toner pages is a color page, wherein, in a case where it is determined that at least one of the clear toner pages is a color page, generating a clear toner page print job for printing the clear toner page and the color page among the insert pages by using the colored toner.

12. The print management method according to claim 8, further comprising:

determining whether a stand-by print job exists in a case where the clear toner page print job is generated, wherein in a case where it is determined that the stand-by print job exists, execution of the clear toner page print job in priority to the stand-by print job is instructed.

13. The print management method according to claim 8, further comprising:

notifying of a message for urging the execution of the insert print job after a time based on the predetermined period of time elapses.

14. A print management method comprising:

identifying, from a document including a clear toner page on which both colored toner and clear toner are used and an insert page on which the colored toner is used without the use of the clear toner, the clear toner page;

instructing printing of the identified clear toner page by using the colored toner without the clear toner; and instructing printing of the insert print job after instructing printing of the identified clear toner page.

15. A computer-readable recording medium having stored thereon computer-executable instructions for causing a print management apparatus to execute a print management method, the computer-readable recording medium comprising:

computer-executable instructions for generating, from a document including a clear toner page on which both colored toner and clear toner are used and an insert page on which the colored toner is used without the use of the clear toner, a clear toner page print job for printing the clear toner page by using the colored toner without using the clear toner, and generating an insert print job for applying the clear toner on the clear toner page printed by using the colored toner without using the clear toner and for printing the insert page by using the colored toner;

computer-executable instructions for instructing an execution of the generated clear toner page print job; and computer-executable instructions for instructing an execution of the generated insert print job generated after a predetermined period of time elapses.

16. A computer-readable recording medium having computer-executable instructions stored thereon for causing a print management apparatus to execute a print management method, the computer-readable recording medium comprising:

computer-executable instructions for identifying, from a document including a clear toner page on which both colored toner and clear toner are used and an insert page on which the colored toner is used without the use of the clear toner, the clear toner page;

computer-executable instructions for instructing printing of the identified clear toner page by using the colored toner without the clear toner; and computer-executable instructions for instructing printing of the insert print job after instruction printing of the identified clear toner page.

* * * * *